US011713605B2

(12) United States Patent
Fischer

(10) Patent No.: US 11,713,605 B2
(45) Date of Patent: Aug. 1, 2023

(54) APPARATUS FOR BARRICADING AN INWARDLY SWINGING DOOR TO PROVIDE PHYSICAL SECURITY

(71) Applicant: Gary Fischer, Houston, TX (US)

(72) Inventor: Gary Fischer, Houston, TX (US)

( * ) Notice: Subject to any disclaimer, the term of this patent is extended or adjusted under 35 U.S.C. 154(b) by 165 days.

(21) Appl. No.: 17/158,773

(22) Filed: Jan. 26, 2021

(65) Prior Publication Data

US 2021/0388652 A1 Dec. 16, 2021

Related U.S. Application Data

(60) Provisional application No. 63/046,832, filed on Jul. 1, 2020, provisional application No. 63/038,317, filed on Jun. 12, 2020.

(51) Int. Cl.
*E05B 63/00* (2006.01)
*E05C 19/18* (2006.01)
(Continued)

(52) U.S. Cl.
CPC ..... *E05C 19/003* (2013.01); *E05B 15/10* (2013.01); *E05C 19/184* (2013.01); *E05B 2063/0039* (2013.01); *Y10T 292/34* (2015.04)

(58) Field of Classification Search
CPC .... E05C 19/003; E05C 19/004; E05C 19/184; E05B 2063/0039; Y10S 292/15;
(Continued)

(56) References Cited

U.S. PATENT DOCUMENTS 1,061,269 A * 5/1913 Coffin ..... E05F 11/00 292/194
1,082,432 A * 12/1913 Mertheimer ..... E05B 5/003 292/288
(Continued)

FOREIGN PATENT DOCUMENTS

DE 202013004894 U1 * 11/2013 ..... E05C 17/54
DE 102013110887 A1 4/2015
GB 2030639 A * 4/1980 ..... E05C 17/54

OTHER PUBLICATIONS

Extended European Search Report regarding corresponding European Patent Application Serial No. 21169401.3, dated Sep. 17, 2021.
(Continued)

*Primary Examiner* — Carlos Lugo
(74) *Attorney, Agent, or Firm* — Lewis & Reese, PLLC

(57) ABSTRACT

A stop to barricade a door from forced entry. The stop includes an upper portion designed to contact the door to barricade it against forced entry, and a lower portion that fits within a receptacle that is recessed into the floor. The stop can be removed from the receptacle when the user doesn't desire to barricade the door. When the stop is placed in the receptacle, the stop is preferably configurable by the user in two modes: a first that allows the user to slightly open the door by a gap, and a second that barricades the door when it is shut. Barricading the door in this second mode is beneficial because it allows the user to look through the gap to verify the identity of a person on the outside of the door, and/or to receive an item through the gap while not opening the door completely.

6 Claims, 25 Drawing Sheets

(51) Int. Cl.
*E05C 19/00* (2006.01)
*E05B 15/10* (2006.01)

(58) Field of Classification Search
CPC .... Y10S 292/19; Y10S 292/44; Y10S 292/60; Y10T 292/23; Y10T 292/34; Y10T 292/37; Y10T 16/61
See application file for complete search history.

(56) References Cited

U.S. PATENT DOCUMENTS 1,808,393 A 6/1931 Wecker
1,944,382 A 1/1934 Wecker
2,553,732 A 5/1951 Young
2,568,477 A 9/1951 Westlund
D167,938 S 10/1952 Grindstad
4,050,723 A 9/1977 Papadatos
4,178,026 A * 12/1979 Sinkhorn ..... E05C 19/18 292/288
4,198,088 A 4/1980 Tochihara
D272,041 S 1/1984 Harris et al.
4,585,259 A 4/1986 Vidas
5,226,201 A * 7/1993 Lefebvre ..... E05C 17/52 292/87
5,383,254 A * 1/1995 Wigley, Sr. ..... E05F 5/06 16/82
5,398,982 A 3/1995 Watson, Jr.
5,454,143 A 10/1995 Wigley
5,454,610 A 10/1995 Taylor et al.
5,458,383 A 10/1995 Gunn
5,489,129 A 2/1996 Shepherd
5,490,304 A * 2/1996 Winner, Jr. ..... E05F 5/06 16/82
5,590,918 A 1/1997 Kambalov
5,601,319 A 2/1997 Morin
5,727,822 A 3/1998 Truong
5,799,367 A * 9/1998 Simon ..... E05C 17/46 292/DIG. 19
5,904,325 A * 5/1999 Hung ..... F16L 3/04 248/74.1
5,983,680 A 11/1999 Del Nin
6,345,849 B1 2/2002 Yen
6,378,917 B1 4/2002 Jones
6,471,264 B1 10/2002 Ryan
6,557,912 B1 * 5/2003 Truong ..... E05C 17/50 292/342
6,629,335 B1 * 10/2003 Derman ..... E05F 5/06 292/DIG. 60
6,708,625 B1 3/2004 Burke et al.
7,021,678 B1 4/2006 Raoult
7,201,408 B2 * 4/2007 Cennamo, Jr. ..... E05B 15/02 292/334
7,367,596 B2 5/2008 Leung
D602,339 S 10/2009 Frankel
7,651,140 B2 1/2010 Leggio
D612,717 S 3/2010 Frankel
D623,499 S 9/2010 Tien
D656,386 S 3/2012 Shen
8,690,201 B2 4/2014 Frazier
8,708,378 B2 4/2014 Frazier
D717,641 S 11/2014 Hugo
8,894,110 B2 11/2014 Taylor et al.
D722,495 S 2/2015 Hugo
D733,520 S 7/2015 Bama
9,121,203 B2 9/2015 Muramatsu et al.
9,238,926 B2 1/2016 Guerrero et al.
9,388,620 B2 7/2016 Endo
9,435,147 B1 9/2016 Giandomenico, Jr. et al.
9,518,421 B2 12/2016 Cushwa, Jr. et al.
9,534,430 B2 1/2017 Taylor et al.
9,562,377 B2 2/2017 Attard
9,598,885 B2 3/2017 Yamamoto et al.
9,799,181 B2 10/2017 Cushwa, Jr. et al.
9,856,682 B1 1/2018 Cook
9,863,172 B2 1/2018 Burke et al.
D813,642 S 3/2018 Tyus
9,957,741 B2 5/2018 Taylor et al.
10,094,154 B2 10/2018 Ploskunak et al.
10,174,532 B2 1/2019 Couturier
10,214,948 B2 2/2019 Richmond
10,316,556 B2 6/2019 Richmond
D853,832 S 7/2019 Cheever et al.
2008/0216524 A1 9/2008 Abdelazeem
2009/0058104 A1 3/2009 Huang
2009/0134640 A1 * 5/2009 Ruffino ..... E05C 19/184 292/338
2011/0291426 A1 * 12/2011 Gibson ..... E05C 19/188 292/137
2014/0159384 A1 6/2014 Frazier
2014/0312634 A1 10/2014 Cushwa, Jr. et al.
2015/0076844 A1 3/2015 Taylor et al.
2016/0230431 A1 8/2016 Yonekura
2017/0211301 A1 7/2017 Richmond
2019/0284853 A1 9/2019 Geenens et al.
2020/0063475 A1 2/2020 Seelbinder et al.

OTHER PUBLICATIONS

Communication Pursuant to Article 94(3) EPC regarding corresponding European Patent Application Serial No. 21169401.3, dated Jul. 14, 2022.
Bolo Stick Door Barricade Installation Guide, retrieved on Jun. 8, 2020 from <https://bolostick.com/bolo-stick-installation-guide>.
DoorJammer: Lockdown Product Information, retrieved on Jun. 8, 2020 from <https://door-jammer.com/doorjammer-lockdown/>.
DoorJammer: Portable Product Information, retrieved on Jun. 8, 2020 from <https://door-jammer.com/doorjammer-portable/>.
Fire Door Armor Product Sheet, Fire Door Solutions, retrieved on Jun. 8, 2020 from <https://firedoorarmor.com/>.
Nightlock® Lockdown 1 | Nightlock Door Security Devices, retrieved on Jun. 8, 2020 from <https://nightlock.com/door-security-devices/door-barricade/nightlock-lockdown>.
OnGUARD Security Door Brace | Door Barricade | Prevents Home Invasions, Burglaries & looters OnGARD Withstands up to 3000 Lbs of Violent Force | On Guard, retrieved on Jun. 9, 2020 from <https://www.amazon.com/Invasions-Burglars-OnGARD-Withstands-Nightlock/dp/B0044EF1GQ>.
The Anchor Product Sheet, Anchorman Inc., retrieved on Jun. 8, 2020 from <www.anchormaninc.com>.

* cited by examiner

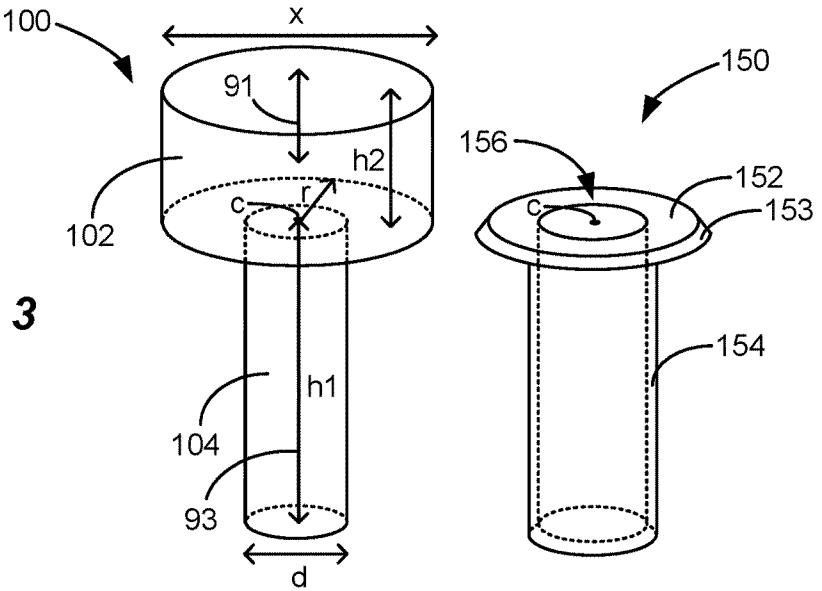
Figure 3
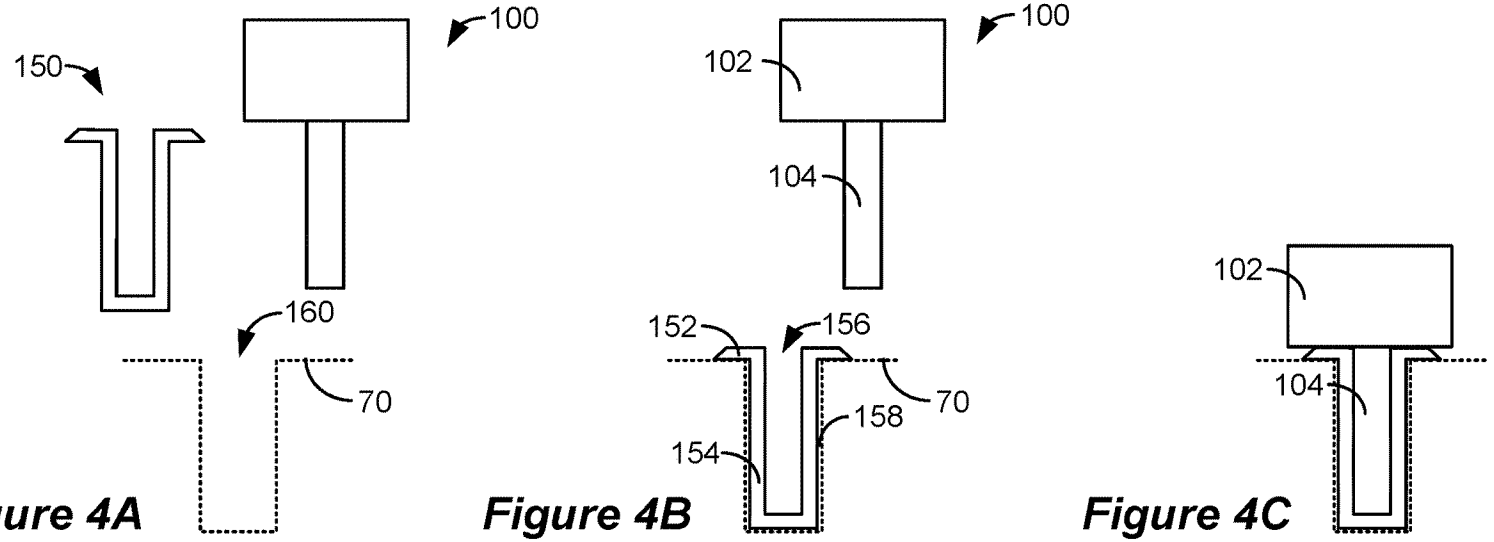
Figure 4A
Figure 4B
Figure 4C

X = door thickness (assume 1.75 in)
Y = gap (assume 1.25 in)
d1 = minimum distance to flat (assume 1 in)
e = thickness of pad 230 (assume 0.25 in)
d2 ~ r = d1 + e = 1 + 0.25 = 1.25

Z = distance to inside of door when closed
Z ~ Y + X + d2 = 1.25 + 1.75 + 1.25 = 4.25 in d1 = minimum distance to flat (assume 1.75 in)
e = thickness of pad 230 (assume 0.25 in)
d2 ~ r = d1 + e = 1 + 0.25 = 1.25 in Z = distance to inside of door when closed
Z ~ d2 = 1.25 in X = door thickness (assume 1.75 in)
Y = gap (assume 1.25 in)
d1 = minimum distance to flat (assume 1 in)

Z = distance to inside of door when closed
Z ~ Y + X + d1 = 4 in.

r = Z ~ 4 in.

X = door thickness (assume 1.75 in)
Y = gap (assume 1.25 in)
d1 = minimum distance (assume 1 in)

Z = distance to inside of door when closed
Z ~ Y + X + d1 = 4 in.

d2 = Z = 4 in.

2r = d1 + d2 = 5 in
r = 2.5 in
r = 2.5 = o + d1 = o + 1
o = 1.5 in

X = door thickness (assume 1.75 in)
Y = gap (assume 1.25 in)
d1 = r (assume 1.5 in)

Z = distance to inside of door when closed
Z ~ Y + X + d1 = 4.5 in.

d2 = Z = 4.5 in.
Z = d1 + L

L = 3 inches

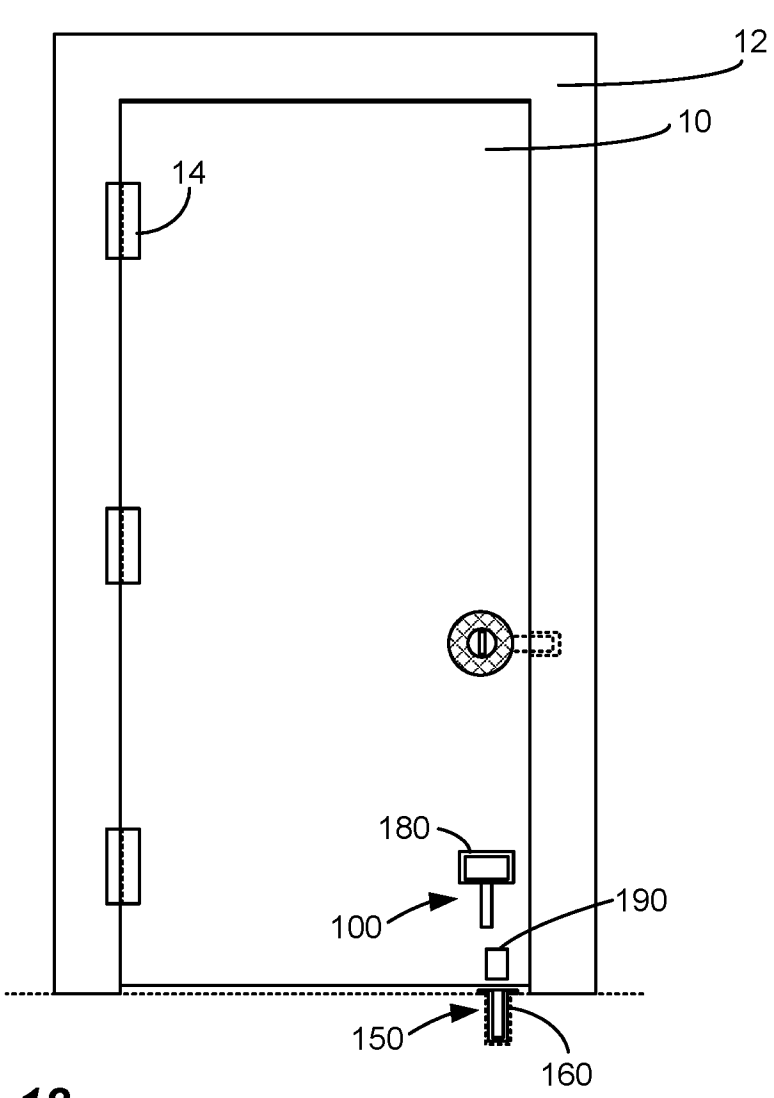
Figure 18
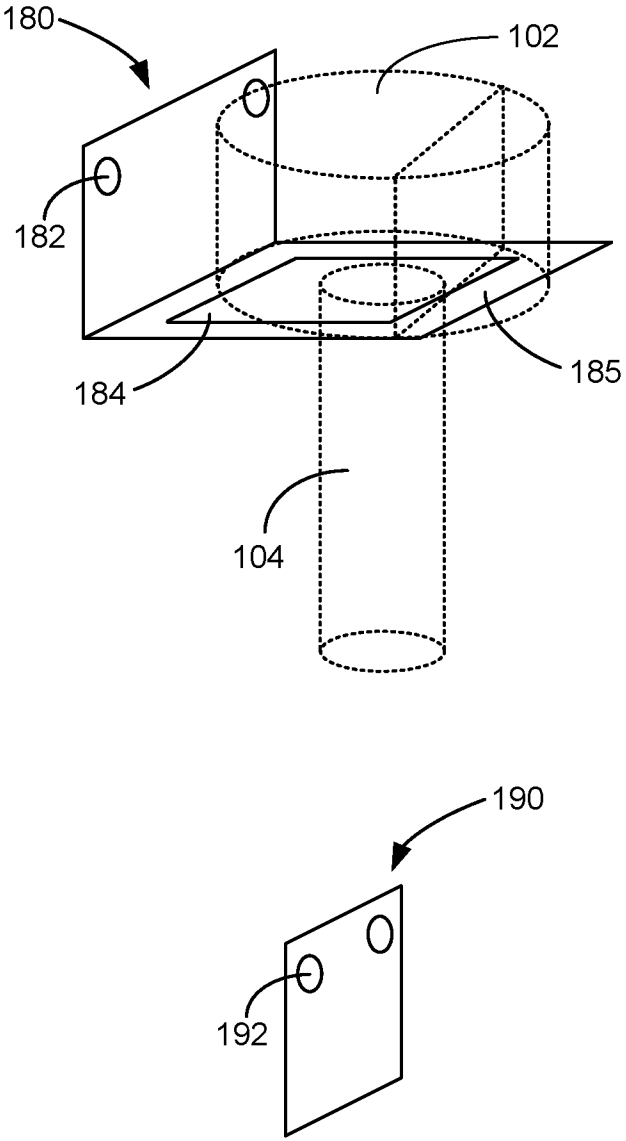

APPARATUS FOR BARRICADING AN INWARDLY SWINGING DOOR TO PROVIDE PHYSICAL SECURITY

CROSS REFERENCE TO RELATED APPLICATIONS

This is a non-provisional application of U.S. Provisional Patent Application Serial Nos. 63/046,832, filed Jul. 1, 2020 and 63/038,317, filed Jun. 12, 2020. These applications are incorporated herein by reference in their entireties, and priority to them is claimed.

FIELD OF THE INVENTION

This application relates to systems for barricading a door, such as is useful in preventing forced entry into a dwelling or business.

INTRODUCTION

Various physical security measures can be used with doors at a dwelling or business that are designed to discourage forced entry into the premises. FIG. 1 shows a door 10, which is typically attached to a frame 12 by hinges 14. FIG. 1 shows various devices that have been used to provide physical door security, which are typically accessible to a user from inside the building being secured. These security measures are well known, and hence only briefly explained. In this example, the door 10 is hinged to allow it to pivot into a building when the door is opened, as is typical when the building comprises a residence.

Element 20 comprises a latch which includes portions mounted (typically using screws) to both the door 10 and the frame 12 (or an adjacent wall more generally). The portion of the latch 20 affixed to the door 10 includes a slidable latch 22, which a user can slide to meet with a loop 24 on the portion affixed to the frame 12. Element 30 comprises a chain latch, which is generally similar to latch 20, although in this latch 30 the portion affixed to the door includes a chain 32 with a bit at its end. A user can position the bit within a slot 34 on the portion affixed to the frame 12. In either of latches 20 or 30, security against forced entry is provided by the sliding latch 22 or the chain 32. However, such security is not perfect. A force provided outside the door such as from an assailant wishing forced entry can cause latches 20 or 30 to fail. Particularly, a sufficient force to the door 10—such as a force pushing the door inwards—c an cause the sliding latch 22 or chain 32 to break, or can cause the screws affixing the devices 20 or 30 to become dislodged from either the door 10 or the frame 12.

Element 40 comprises a well-known door knob. When the knob is turned, a latch 44 is retracted into the door 10 from a recess 46 that has been morticed into the frame 12, thus allowing the door to be opened. When not turned, or when locked such as by using a key (not shown) or thumb turn 42, the latch 44 will remain extended in the recess 46, thus providing physical security against forced entry via force provided by the latch 44 against the door frame 12. Element 50 is typically called a "dead bolt." Like knob 40, dead bolt 50 includes a latch 54 which can be retracted from or extended into a recess 56 provided in the door frame 12, again using a key or a thumb turn 52. Door knobs 40 and dead bolts 50 also do not provide complete security against forced entry. In both cases, a sufficient outside force on the door 10 can cause the door knob 40 or dead bolt 50 to fail. Particularly, the recesses 46 or 56 morticed into the door frame 12 reduce the door frame material, thus weakening the material against external forces, raising the possibility that the latches 44 or 54 will break through the recesses 46 or 56. A strike plate (not shown) can be affixed (screwed) to the frame 12 over the recesses which will add further structural integrity against external forces, but such protection is limited by the strength of the screws involved.

Element 60 comprises another form of a door latch. In this example, a portion 64 is affixed to, or within, the door 10, which includes a sliding latch 66. This latch 66 can slide into a hole 68 morticed in the floor 70. The sliding latch 66 may be controlled by a key or thumb turn 62. Like latches 20 and 30 however, latch 60 can be prone to failure. A sufficient force outside the door 10 can cause the portion 64 affixed to the door 10 to become dislodged, or the latch 66 to be broken.

SUMMARY

A system useable to barricade a door is disclosed, which may comprise: a stop comprising an upper portion configured to contact a door, and a lower portion connected to an underside of the upper portion; and a receptacle comprising an opening to receive the lower portion of the stop when the stop is placed in the receptacle, wherein the receptacle is configured to be positioned in a hole in a floor proximate the door, wherein the stop when placed in receptacle is configurable by a user in a first mode and a second mode, wherein in the first mode the door can be opened by a gap before contacting the upper portion, and wherein in the second mode the upper portion barricades the door while the door is closed.

In one example, the lower portion and opening are cylindrical. In one example, the stop is configurable in the first and second modes by rotating the stop within the receptacle. In one example, the upper portion includes a surface, wherein the stop is configurable in the first mode by rotating the stop to cause the surface to face the door, and wherein the stop is configurable in the second mode by rotating the stop to cause the surface to face away from the door. In one example, the surface comprises a flat surface. In one example, in the first mode the door contacts the upper portion at the surface. In one example, a central axis of the lower portion is colinear with a central axis of the upper portion. In one example, a central axis of the lower portion is offset with respect to a central axis of the upper portion. In one example, the central axis of the lower portion is offset in the direction of the surface. In one example, a central axis of the lower portion is offset with respect to a central axis of the upper portion, whereby the lower portion is brought closer to a first location on the periphery of the upper portion and farther away from a second location on the periphery of the upper portion. In one example, the stop is configurable in the first mode by rotating the stop to cause the first location to face the door, and wherein the stop is configurable in the second mode by rotating the stop to cause the second location to face the door. In one example, at least a portion of a periphery of the upper portion is cylindrical. In one example, the upper portion comprises a first portion connected to the lower portion, and an extension connectable to the first portion. In one example, the stop is configurable in the first mode by not connecting the extension to the first portion, and wherein the stop is configurable in the second mode by connecting the extension to the first portion. In one example, the first portion includes a first surface, wherein in the first mode the first surface faces the door. In one example, in the first mode the door contacts the upper portion at the first surface. In one example, in the second mode the extension faces the door. In one example, the upper portion and lower portion are integrally formed as a single piece. In one example, the upper portion and lower portion comprises separate pieces that are connected by the user. In one example, when the stop is not placed in the receptacle, the door can be opened by passing over the receptacle in the floor.

A method for barricading a door is disclosed, which may comprise: affixing a receptacle in a hole in a floor proximate to a door, wherein the receptacle comprises an opening; placing a stop in the receptacle, wherein the stop comprises an upper portion and a cylindrical lower portion connected to an underside of the upper portion, wherein the stop is placed in the receptacle by sliding the lower portion into the opening; and configuring at different times the stop in a first mode and a second mode, wherein in the first mode the door can be opened by a gap before contacting the upper portion, and wherein in the second mode the upper portion barricades the door while the door is closed.

In one example, the stop is configured in the first and second modes by rotating the stop within the receptacle. In one example, the upper portion includes a surface, wherein the stop is configured in the first mode by rotating the stop to cause the surface to face the door, and wherein the stop is configured in the second mode by rotating the stop to cause the surface to face away from the door. In one example, a central axis of the lower portion is offset with respect to a central axis of the upper portion, whereby the lower portion is brought closer to a first location on the periphery of the upper portion and farther away from a second location on the periphery of the upper portion. In one example, the stop is configured in the first mode by rotating the stop to cause the first location to face the door, and wherein the stop is configured in the second mode by rotating the stop to cause the second location to face the door. In one example, the upper portion comprises a first portion connected to the lower portion, and an extension connectable to the first portion. In one example, the stop is configured in the first mode by not connecting the extension to the first portion, and wherein the stop is configured in the second mode by connecting the extension to the first portion. In one example, the first portion includes a first surface, wherein in the first mode the door contacts the upper portion at the first surface. In one example, in the second mode the extension faces the door. In one example, the method further comprises removing the stop from the receptacle to allow the door to be opened by passing over the receptacle in the floor.

A system useable to barricade a door is disclosed, which may comprise: a stop comprising an upper portion and a cylindrical lower portion connected to an underside of the upper portion, wherein the upper portion includes a flat vertical surface; and a receptacle comprising a cylindrical opening to receive the lower portion of the stop when the stop is placed in the receptacle, wherein the receptacle is configured to be positioned in a hole in a floor proximate the door, wherein the lower portion is rotatable within the opening by a user to cause the surface to face the door, thus allowing the door to contact the surface to barricade the door.

In one example, the upper portion comprises a first portion and a pad affixed to the first portion, wherein the cylindrical lower portion is connected to an underside of the first portion. In one example, the pad comprises the flat vertical surface. In one example, the pad comprises a rubber material. In one example, the pad comprises a deformable material. In one example, the pad is affixed to the first portion by an adhesive. In one example, the pad is molded to the first portion. In one example, a central axis of the lower portion is colinear with a central axis of the upper portion. In one example, at least a portion of a periphery of the upper portion is cylindrical. In one example, the upper portion and lower portion are integrally formed as a single piece. In one example, the upper portion and lower portion comprises separate pieces that are connected by the user. In one example, when the stop is not placed in the receptacle, the door can be opened by passing over the receptacle in the floor. In one example, neither the receptacle nor the stop is affixed to the door.

A method for barricading a door is disclosed, which may comprise: affixing a receptacle in a hole in a floor proximate to a door, wherein the receptacle comprises a cylindrical opening; placing a stop in the receptacle, wherein the stop comprises an upper portion and a cylindrical lower portion connected to an underside of the upper portion, wherein the upper portion includes a flat vertical surface, wherein the stop is placed in the receptacle by sliding the lower portion into the opening; and rotating the lower portion within the opening to cause the surface to face the door, thus allowing the door to contact the surface to barricade the door.

In one example, the upper portion comprises a first portion and a pad affixed to the first portion, wherein the cylindrical lower portion is connected to an underside of the first portion. In one example, the pad comprises the flat vertical surface. In one example, the pad comprises a rubber or deformable material. In one example, the pad is affixed to the first portion by an adhesive. In one example, a central axis of the lower portion is colinear with a central axis of the upper portion. In one example, the method further comprises removing the stop from the receptacle to allow the door to be opened by passing over the receptacle in the floor.

BRIEF DESCRIPTION OF THE DRAWINGS

FIG. 3 show a first example of the stop and receptacle.

FIGS. 4A-4C show how the receptacle can be installed in a floor, and how the receptacle can thereafter receive the stop to barricade the door.

FIG. 18 shows that the system may include a hanging device to store the stop, and a strike plate to protect the door at the location where it contacts the stop.

DETAILED DESCRIPTION

Figure 2:
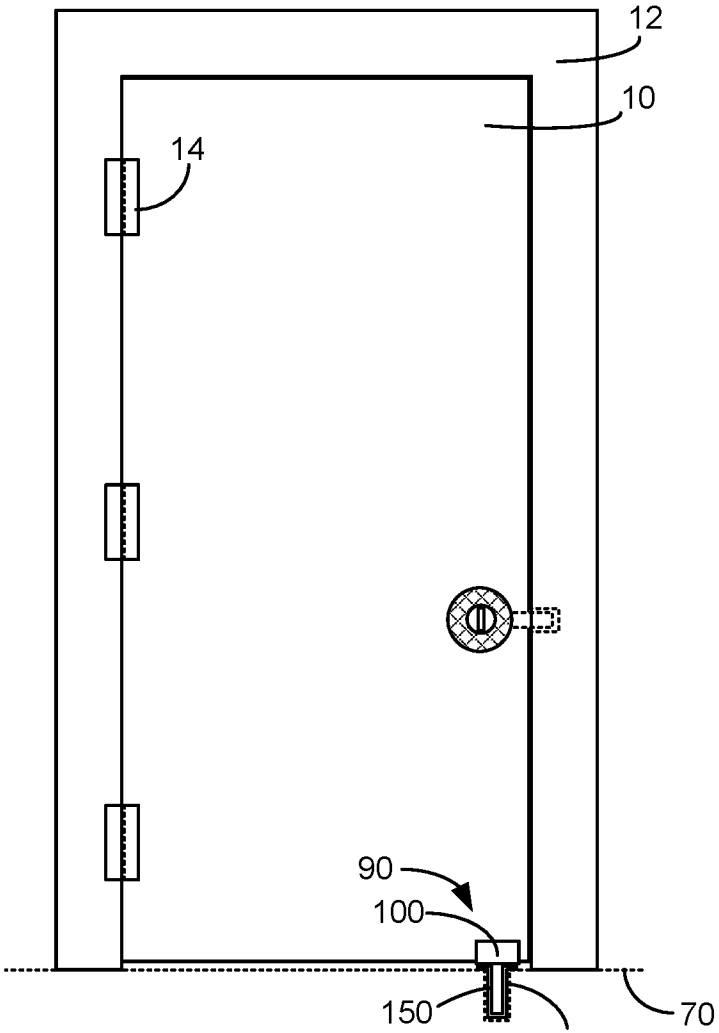
FIG. 2 shows a door barricading system, including a stop and receptacle, in position relative to a door being barricaded.

By way of summary, and referring to element numerals described later herein, various aspects of Applicant's invention involve the use of a stop 100 to barricade a door 10 from forced entry. The stop 100 is not mechanically affixed to the door. Instead, the stop 100 includes an upper portion 102 designed to contact the door 10 (e.g., the door's inside surface) to barricade against forced entry, and a lower portion 104 that preferably fits within a receptacle 150 that is recessed into the floor 70. The stop 100 can be removed from the receptacle 150 when the user doesn't desire to barricade the door, such as when the user may wish to open the door 10. When the stop 100 is placed in the receptacle 150 to barricade the door 10, the stop 100 may be configurable by the user in two modes: a first mode that allows the user to slightly open the door by a gap 108, and a second mode that barricades the door 10 when it is closed in the frame 12. Barricading the door 10 in the first mode is beneficial because it allows the user to look through the gap 108 to verify the identity of a person on the outside of the door, and/or to receive an item (e.g., a letter) through the gap while not opening the door completely and keeping it barricaded, as explained further below. The stop 100, if not configurable by the user, may also be installed in the first or second modes.

Figure 1:
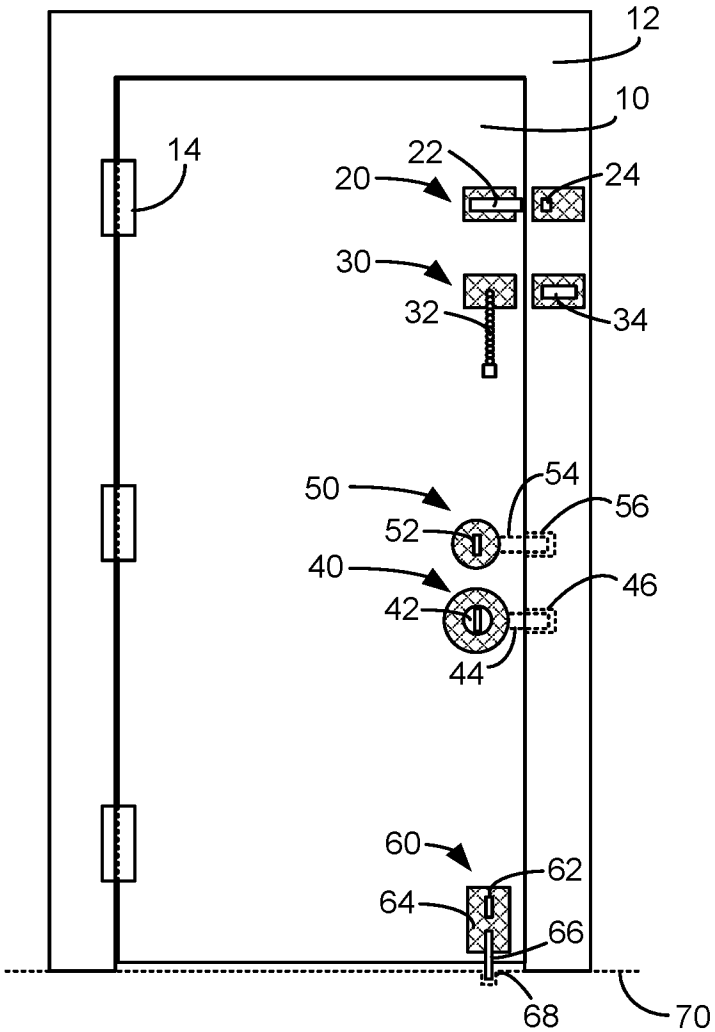
Figure 1 (prior art)
FIG. 1 shows various physical security measures that can be used with doors at a dwelling or business to discourage forced entry into the premises, in accordance with the prior art.

FIG. 2 shows a first example of a barricading system 90, which includes the stop 100 and receptacle 150 just mentioned. FIG. 2 shows the stop 100 and receptacle 150 in place with respect to a door 10 that is being secured, while FIG. 3 shows these components in isolation. As best seen in FIG. 3, the stop 100 as mentioned above includes an upper portion 102 designed to contact the door 10 to barricade against forced entry, and a lower portion 104 that preferably fits within an opening 156 in the receptacle 150. In this example, both the upper and lower portions 102 and 104 are cylindrical. However, either of these components 102 or 104 can be made of different shapes, some of which are shown in later figures. Note that a door 10 secured by the system 90 may be protected by other physical security measures as well, such as those described with respect to FIG. 1.

The receptacle 150 includes a sidewall 154 whose inner diameter defines the size of the opening 156, and whose outer diameter is designed to fit in a hole 160 drilled in the floor 70. Preferably, the receptacle 150 also includes a horizontal lip 152 that overlies the floor 70 when the receptacle 150 is installed in the hole 160. The lip 152 may include a beveled edge 153 to smooth the transition from the top of the floor 70 to the top of the lip 152. Although not shown, the lip 156 may also be morticed into the floor 70 so that it is flush with the top of the floor. Furthermore, the lip 152 may be absent, in which case the receptacle 150 may include only the sidewall 154 which may be made flush with the top of the floor 70.

FIGS. 4A-4C show steps involved in the installation of the receptacle 150, and subsequent use of the stop 100 as part of the system 90. As shown in FIG. 4A, the hole 160 is drilled in the floor 70 proximate to and inside of the door 10. The location at which the hole 160 is drilled relative to the door 10 will depend on the dimensions of the stop 100, as explained subsequently. Typically, the floor 70 comprises a solid substrate such as a cement foundation, wood, or the like. After the hole 160 is drilled, and as shown in FIG. 4B, the sidewall 154 of the receptacle 150 is preferably secured within the hole 160, such as by the use of an adhesive or cementing material 158. Thereafter, as shown in FIG. 4C, the user may slide the lower portion 104 of the stop 100 within the receptacle's opening 156, which acts to barricade the door 10 as explained subsequently. Preferably, the height (h1) of the lower portion 104 is equal to the depth of the opening 156, such that when the stop 100 is positioned in place, the bottom of its upper portion 102 will rest on the upper surface of the lip 152. This provides stability, as well as keeps the stop 100 from damaging the floor 70. That being said, if the receptacle 150 doesn't include a lip 152, the upper portion 102 may rest on the top surface of the floor 70. Because the lower portion 104 is designed to slide into opening 156 of the receptacle 150, this lower portion 104 and opening 156 would have the same shape (e.g., cylindrical, rectangular, etc.).

The stop 100 and receptacle 152 may be made of various materials, and preferably are formed of materials with good mechanical strength able to provide barricading functionality without breaking. For example, these components may be formed of aluminum, steel, or high-density plastics such as PTFE, high-density rubbers, etc. The stop 100—i.e., the upper and lower portions 102 and 104—is preferably solid for best mechanical strength. However, in other examples, the upper and lower portions 102 and 104 may be hollow to some degree, which can be useful to reduce the weight of the stop 100. The stop 100 and/or the receptacle 150 are shown thus far as comprising singular pieces, and may be milled, cut or molded as such. However, as explained later, these components can comprise individual pieces that are affixed together.

As mentioned above, the lower portion 104 of the stop 100 is preferably sized to slide into, and rotate within, the opening 156. That being said, these portions also preferably have a tight tolerance, such that the lower portion 104 is firmly retained (and will not "wiggle") within the opening 156. As explained later, the dimensions of the stop 100 and the receptacle 150 can vary, and it should be understood that the drawings do not necessarily depict these components to scale. To provide some idea of envisioned sizing of the stop 100 and receptacle 150, and referring to FIG. 3, the lower portion 104 may have a diameter (d) in the range of 0.5-1.5 inches and a height (h1) of 2.0-4.0 inches, which would also set the dimensions of the corresponding opening 156 in the receptacle 150. The upper portion 102 may have a height (h2) of 1.5-4.0 inches to provide a suitably large and secure contact surface with the door 10 that is being barricaded. The maximum horizontal dimension (x) of the upper portion 102 can vary in different examples, as explained further below, but may generally be in the range of 2.0-8.0 inches.

Figure 5B:
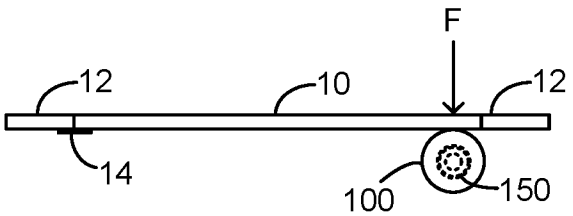
FIGS. 5A-5B show operation of the stop to barricade a door when it is closed in a door frame.
Figure 5B:
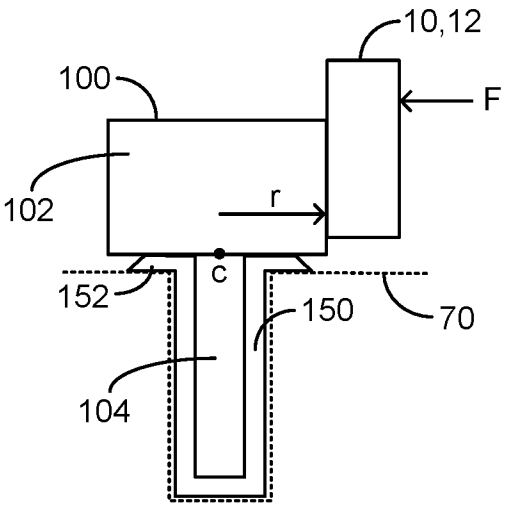
Figure 5A:
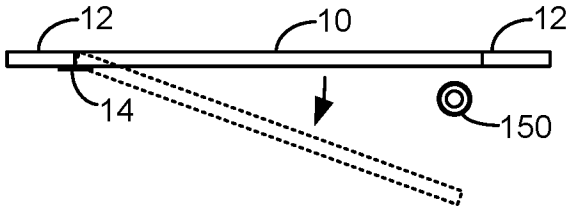
Figure 5A:
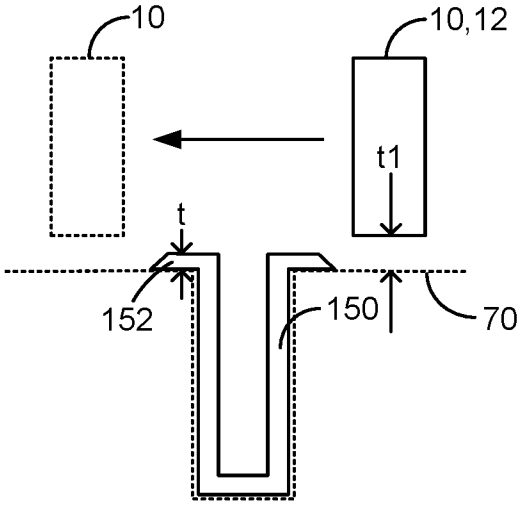

In the example of the stop 100 shown in FIG. 3, the upper and lower portions 102 and 104 are cylindrical, having central axes 91 and 93 respectively that are colinear and passing through a point 'c'. FIGS. 5A and 5B show use of this example of the stop 100, in both top-down and cross-sectional views. Note that the receptacle 150 is preferably mounted in the floor 70 just inside the door 10 (e.g. a few inches), and proximate to the edge of the door that will swing inward. In FIG. 5A, the user has not placed the stop 100 in the receptacle 150, and as a result, the door 10 can be opened and swing over the empty receptacle 150. In this regard, notice that it is important that the lip 152 of the receptacle 150 (if present) have a thickness t that is less than the clearance t1 between the bottom of the door 10 and the floor 70.

In FIG. 5B, the user has closed the door 10 within frame 12, and has placed the stop 100 within the receptacle 150. As shown in the cross section, this positions the vertical surface of the upper portion 102 into contact (or very near contact) with the inside surface of the door. Notice that such contact is established because the receptacle 150 is installed in the floor 70 at a location such that center point 'c' is located at a distance from the inside surface of the door that approximately equals the radius 'r' of the upper portion 102. As such, the stop 100 provides a barricading function to prevent the door 10 from opening when subject to an external force F, such as that provided by an assailant wishing forced entry. Good barricading functionality is provided for a number of reasons relating to the system's design. The upper portion 102 of the stop 100, given its height (h2, FIG. 3), provides a significant contact surface to transfer the force F to the lower portion 104. This lower portion 104 is well fit within the opening 156 in the receptacle 150, and the sidewall 154 of the receptacle 150 is in turn well affixed mechanically within the floor 70. The lower portion 104 has a significant contact surface (h1, FIG. 3) with the receptacle 150 to transfer the force F to the floor 70. Notice also that height of the lower portion 104 makes it unlikely that an assailant could pry the stop 100 out of the receptacle 150, such as by attempting to reach under the door 10 with a tool. Of course, should the user decide to open the door 10 at some later time, he can simply remove the stop 100 from the receptacle 150 (FIG. 5A) and place or store it near the door 10 for later use.

Especially given the mechanical strength and thickness of the materials involved, the stop 100 will be able to withstand the force F without breaking. Furthermore, notice that the design of the system 90 is simple, and involves few parts that are easily and cheaply manufactured. Unlike other door-barricading approaches, no parts of the system 90 are permanently attached to the door 10 or to the frame 12, which is beneficial because as noted earlier such attachment means (e.g., screws) can be a point of weakness that can break in response to the force F. Still further, the system does not involve moving parts (e.g., latches, chains, etc.), which can also break. In short, good and reliable barricading functionality is provided by the system 90 in a cost-effective manner that is easy to manufacture, install, and use.

Figure 6A:
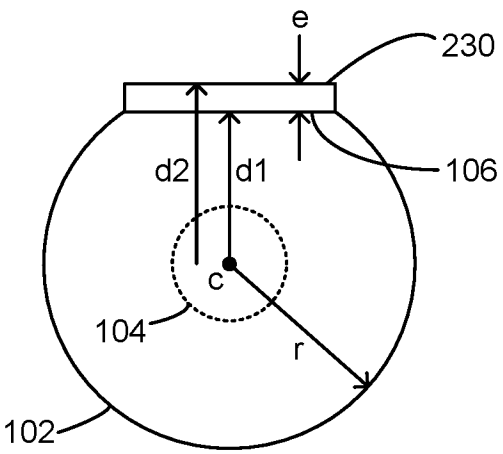
FIGS. 6A-6C show a second example of a stop to barricade a door when it is closed in a door frame, including the ability to install the system so that it is useable in one of two modes of operation: a first mode (FIG. 6B) allowing a door to be barricaded while opened by a small gap, and a second mode (FIG. 6C) allowing the door to be barricaded when closed in a door frame.
Figure 6A:
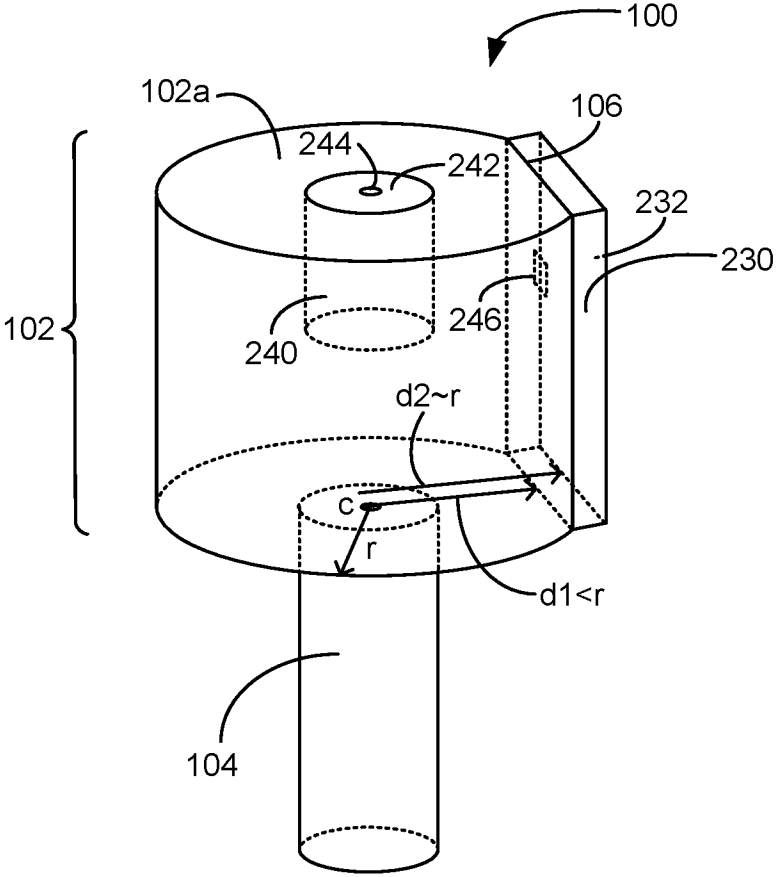
Figure 6B:
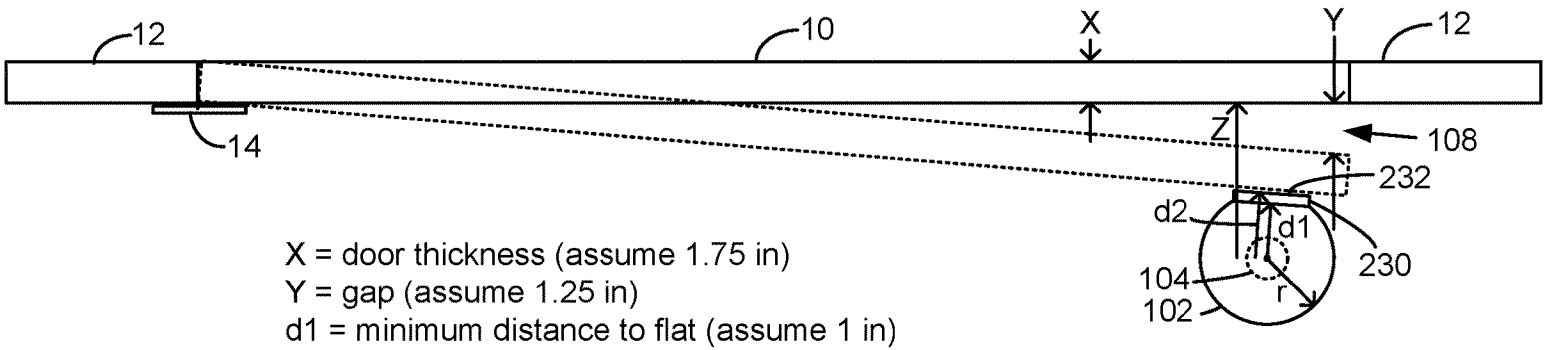
Figure 6C:
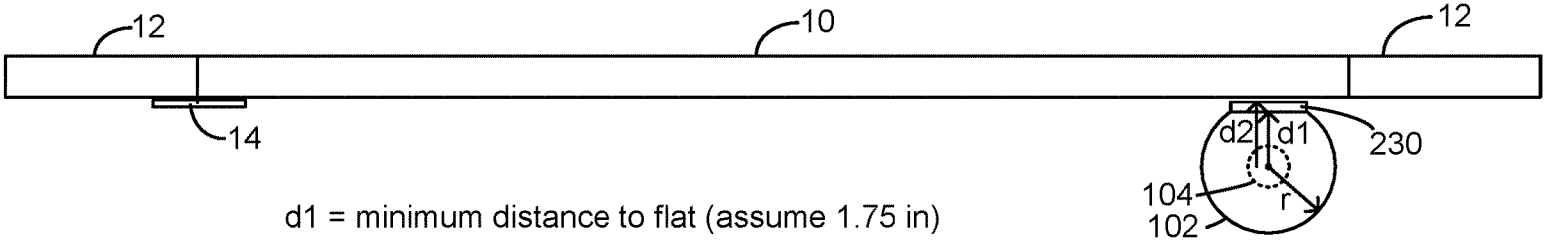

FIGS. 6A-6C show another version of the stop 100. In this example of the stop 100, the upper portion 102 is again largely cylindrical, having an axis which is again colinear with the cylindrical lower portion 104, with these portions having axes passing through center point c. A chord has been cut from the otherwise cylindrical shape of the upper portion 102 to form a flat vertical surface 106. As shown, a pad 230 has been affixed to the surface 106. The pad 230 has a flat vertical surface 232 that is designed to contact and brace the door 10, as explained further below. In one example, the pad 230 is comprised of a high-density rubber or plastic, and while rigid is preferably also slightly deformable to absorb an external force F that might be applied to the door 10. The pad 230 may be affixed to the surface 106 using an adhesive, or may be molded onto the upper portion 102. The surface 232 provides a large-area contact surface, which is helpful to dispersing an external force F on the door 10, and transferring that force to the lower portion 104 and the floor-mounted receptacle 150. Further, because the surface 232 is planar, and somewhat deformable, contact between the door and the pad 230 is less likely to damage or mar the inside surface of the door. In a preferred example, the pad 230 has a thickness e, and a distance d2 from center c to the surface 232 that is approximately equal to the radius r of the cylindrical first portion 102*a*. Minimum distance d1 from the center c to the surface 106 would equal d2−e.

FIGS. 6B and 6C show stop 100 in operation, and illustrate the stop 100 installed in two different modes. In FIG. 6B shows a first mode, in which the receptacle 150 (not shown, but receiving lower portion 104) is installed further away from the door 10. When installed in this position, the door 10 can be opened by a gap 108 while still being barricaded against forced entry. As noted earlier, gap 108 allows a user to verify the identity of a person on the outside of the door, and/or to receive an item through the gap while not opening the door completely and keeping it barricaded. The user has placed and rotated the stop 100 within the receptacle 150 such that the flat surface 232 of the pad 230 generally faces the door 10. Example dimensions are shown, and it is assumed that the door 10 has a thickness (X) of 1.75 inches, and that a gap 108 (Y) of 1.25 inches is desired. It is further assumed that distance d1 to the flat surface 106 is 1 inch, and that the pad 230 has a thickness e of 0.25 inches. This means that the distance d2 to the pad 230 is 1.25 inches (d1+e), which also defines the radius r of the upper portion 102. These dimensions inform where the system 90 should be installed relative to the door—i.e., where the receptacle 150 should be installed in the floor 70. Specifically, Z, which denotes the distance from center c when the door is closed, will approximately equal Y+Y+d2, or 4.25 inches. Note that it is not strictly necessary that the surface 232 of the pad 230 be positioned exactly parallel to the door 10. If the surface 232 is slightly angled with respect to the door 10 at the point of contact, the application of a significant force F will cause the stop 100 to rotate in the receptacle 150 until the flat surface 232 and door 10 are brought parallel.

FIG. 6C shows the stop 100 installed in a second mode, in which the receptacle 150 barricades the door 10 when it is closed. This second mode is less flexible because the user can't open the door by a gap 108, but is more secure because the door 10 is barricaded by the stop 100 when the door is closed in frame 12. In this second mode, the system 90 is installed closer to the door 10. Specifically, distance Z generally equals d2 or r of the upper portion (1.25 in). The user can choose during installation whether they prefer a solution that allows the door to be opened by a gap 108 (FIG. 6B) or a solution that barricades the door while shut (FIG. 6C).

FIG. 6A shows that electronics can be incorporated with the stop 100. In this regard, part of the upper portion 102 (e.g., the first portion 102*a*) can be hollowed out to include an electronics chamber 240 covered by a lid 242. The lid 242 can include a light source such as a light emitting diode (LED) 244. This is useful as it allows the stop 100 to act as a night light, or to otherwise indicate the location of the stop 100, which might be useful to prevent a person from tripping on the stop 100 when it is in use to barricade the door. Although not shown, one skilled in the art will understand that the electronics chamber 240 could include a battery and necessary circuitry (e.g., a circuit board) to run the LED. Further, although not shown, the lid 242 could include an on/off switch to operate the LED 244.

Stop 100 can also include a pressure sensor 246 to sense a force that has been imparted to the surface 232. The pressure sensor 246 can be positioned at the junction between the surface 106 of the first portion 102*a* and the pad 230, and can communicate with the electronics in the chamber 240. The pressure sensor 246 can be any device capable of sensing force, such as a load cell or an accelerometer. If the sensor 246 and associated electronics detects a force beyond a threshold, i.e., a large force that would suggest that unauthorized entry into the premises is being attempted, the stop 100 can wirelessly notify the user (e.g., their cell phone) or the premise's home security system of that fact. In this regard, the electronics in chamber 240 could include telemetry circuitry (e.g., a Bluetooth antenna). Electronics such as those described could appear in any of the disclosed examples of the stop, but for brevity these electronics are only shown in the stop 100 of FIG. 6A.

In other examples, the system 90 can be modified to allow a user to configure the system into the two modes described earlier. In these examples, the user can configure the stop 100 after it is installed in the floor to either permit the door to be opened by a gap 108 (first mode) or to barricade the door when it is closed (second mode).

An example of a stop 100 that provides such dual-mode functionality is shown in FIGS. 7A-7E. The stop 100 as shown in FIG. 7A again includes a flat vertical surface 106, similar to what was shown in FIGS. 6A-6C. This surface 106 could again include a pad 230, but this detail isn't shown for simplicity. This surface 106 is cut resulting in a minimum distance d1 from the center point 'c' to the flat surface 106 that is smaller than the radius 'r' of the upper portion 102.

Figure 7A:
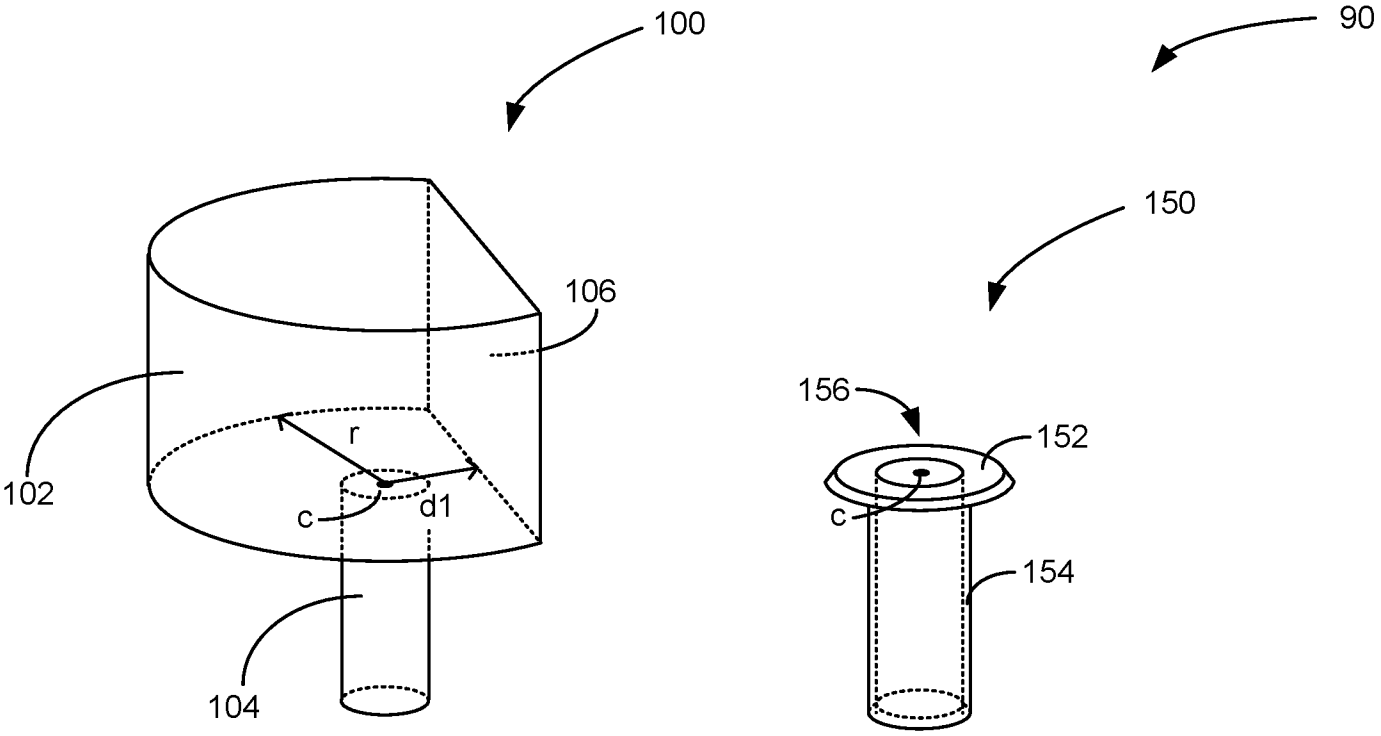
FIGS. 7A-7E show an example of the stop and receptacle, in which the stop is configurable (e.g., rotatable) by a user after installation in two modes of operation: a first mode (FIGS. 7B & 7D) allowing a door to be barricaded while opened by a small gap, and a second mode (FIGS. 7C and 7E) allowing the door to be barricaded when closed in a door frame.
Figure 7C:
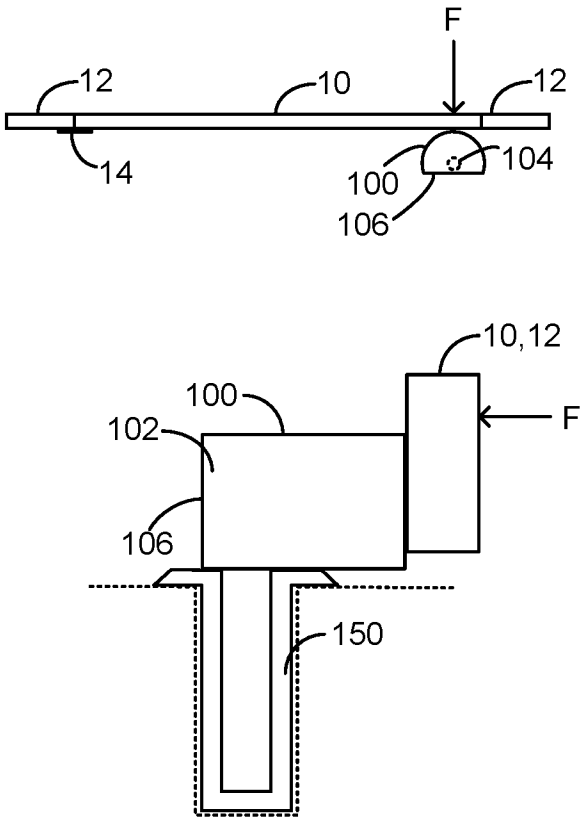
Figure 7B:
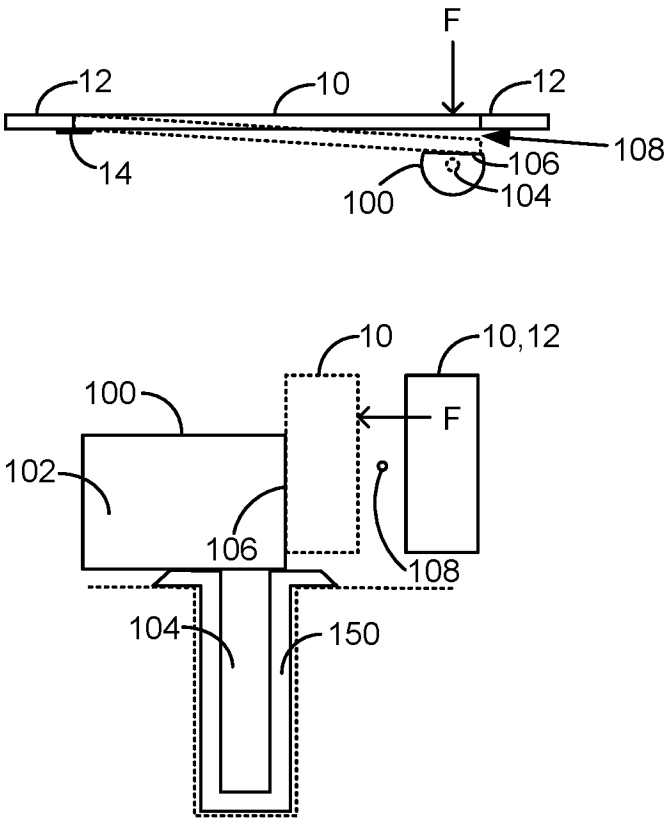

FIG. 7B shows use of the stop 100 as configured by the user in the first mode. In this first mode, the user has placed the stop 100 in the receptacle 150 and has rotated it (i.e., turned lower portion 104 in opening 156) so that the flat surface 106 generally faces the door 10. Minimum distance d1 allows the door 10 to open a small amount before it comes to rest at the flat surface 106, thus creating a gap 108 between the edge of the door 10 and the frame 12. However, the door 10 is still barricaded when it contacts the flat surface 106, such that an external force F will be ineffective to try and force the door open further, for the reasons explained earlier. In short, configuring the stop 100 in the first mode allows the user to open the door 10 by a gap 108 while the door 10 is still barricaded and cannot be forced opened further. Note that it is not strictly necessary that the surface 106 be positioned exactly parallel to the door 10 in this first mode. As explained earlier, if the surface 106 is slightly angled with respect to the door 10 at the point of contact, the application of a significant force F will cause the stop 100 to rotate in the receptacle 150 until the flat surface 106 and door 10 are brought parallel.

FIG. 7C shows use of the stop 100 as configured by the user in the second mode to barricade the door 10 when it is closed in the frame 12. In this second mode, the user has shut the door 10, and has placed the stop 100 in the receptacle 150 and turned it so that the flat surface 106 generally faces away from the door 10. In this second mode, the larger radius r of the upper portion 102 (FIG. 7A) is sufficient to contact (or nearly contact) the door 10 when it is closed in the frame. Thus, the door 10 is barricaded shut in this example.

Notice that it is easy for a user to switch the system 90 between these two modes. For example, a user at home can close the door 10 and place the stop 100 in the second mode (FIG. 7C) when at home to provide security. If a visitor knocks or rings the door bell, the user can reach down and turn the stop 100 to the first mode (FIG. 7B) to allow the door to be opened by a gap 108, while still keeping the door barricaded. After the visitor has left, the user can again close the door 10 and reach down and turn the stop 100 back to the second mode (FIG. 7C) to re-secure the door in its closed state. If the user later needs to open the door 10 fully, the user can simply remove stop 100 from the receptacle 150 and place it nearby until it is needed again.

Figure 7D:
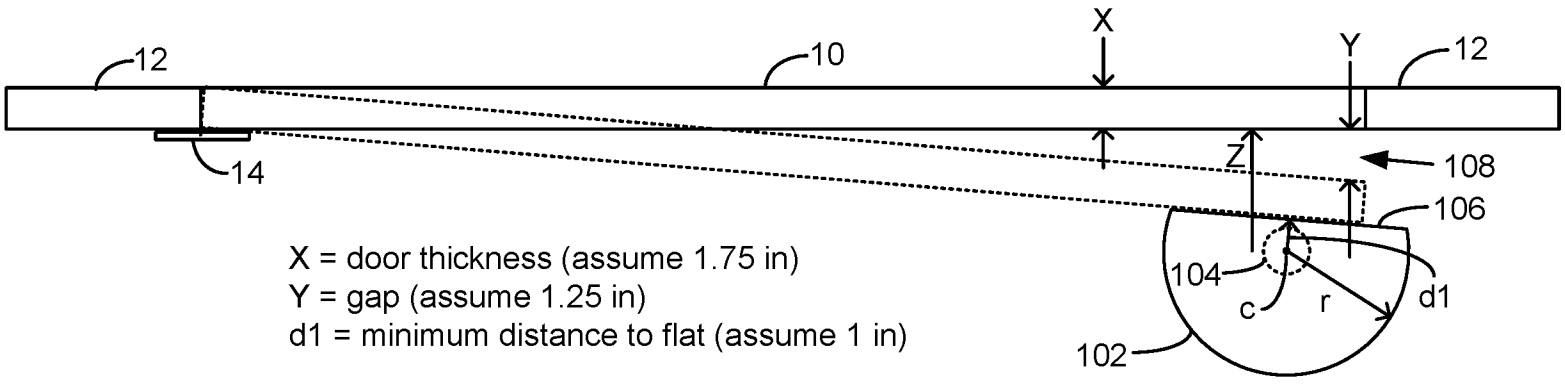
Figure 7E:
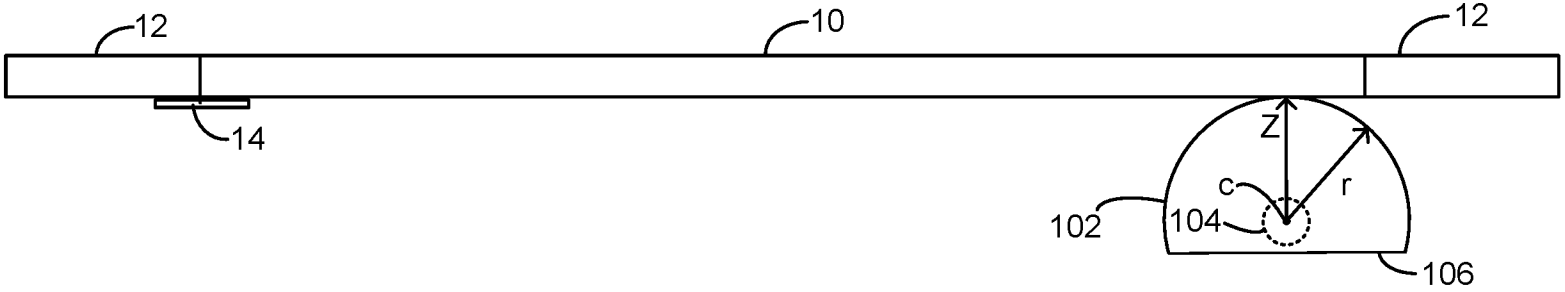

FIGS. 7D and 7E provide an analysis of some of the dimensions inherent in the system, and the interrelationships between those dimensions. Assume that a typical door 10 has a thickness (X) of 1.75 inches, and that it is desirable that the upper portion 102 provide a gap 108 (Y) of 1.25 inches when configured in the first mode (FIG. 7D). Assume further that the flat surface 106 of the upper portion 102 has been cut so that minimum distance d1 equals 1 inch from the center point 'c' of the cylindrical upper portion and lower portions 102 and 104. The distance Z from the center point 'c' to the inside of the door 10 when it is closed in the frame would be approximately Y+X+d1, or 4 inches, which informs where the receptacle 150 should be installed in the floor 70. (This approximation trigonometrically ignores the small angle that forms when the door is opened by the gap 108). Further, the radius r of the upper portion 102 must equal Z (again approximately 4 inches) so that the upper portion 102, when rotated in the second mode, will barricade the door when it is closed (FIG. 7E).

Figure 8A:
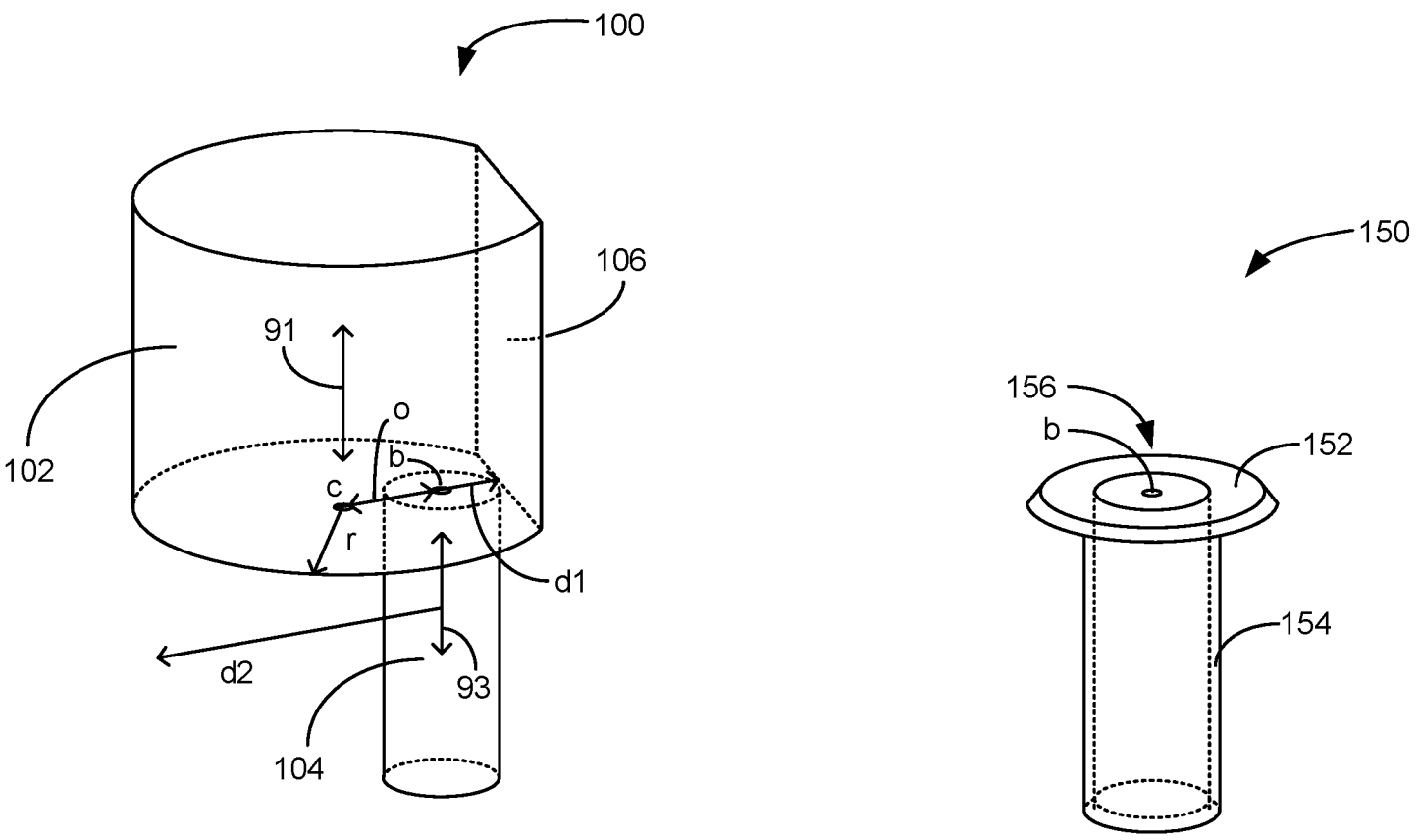
FIGS. 8A-8C show another example of the stop and receptacle configurable in the two modes of operation by rotation.

While these dimensions are merely examples, and can be suitable for a given application, these dimensions may also result in a stop 100 with an upper portion 102 that is larger or heavier than desired. To address this issue, other examples can offset the lower portion 104 from the center of the upper portion 102, as shown first in the example of FIGS. 8A-8C. Notice in FIG. 8A that a center point 'b' passing through the central axis 93 of the lower portion 104 has been offset by a distance 'o' from the center 'c' through the central axis 91 of the upper portion 102, thus bringing the lower portion 104 closer to the flat surface 106. As such, a minimum distance d1 is defined from 'b' to the flat surface 106, while a maximum distance d2 is defined from 'b' to the vertical edge of the upper surface 102 opposite the flat surface 106.

Figure 8B:
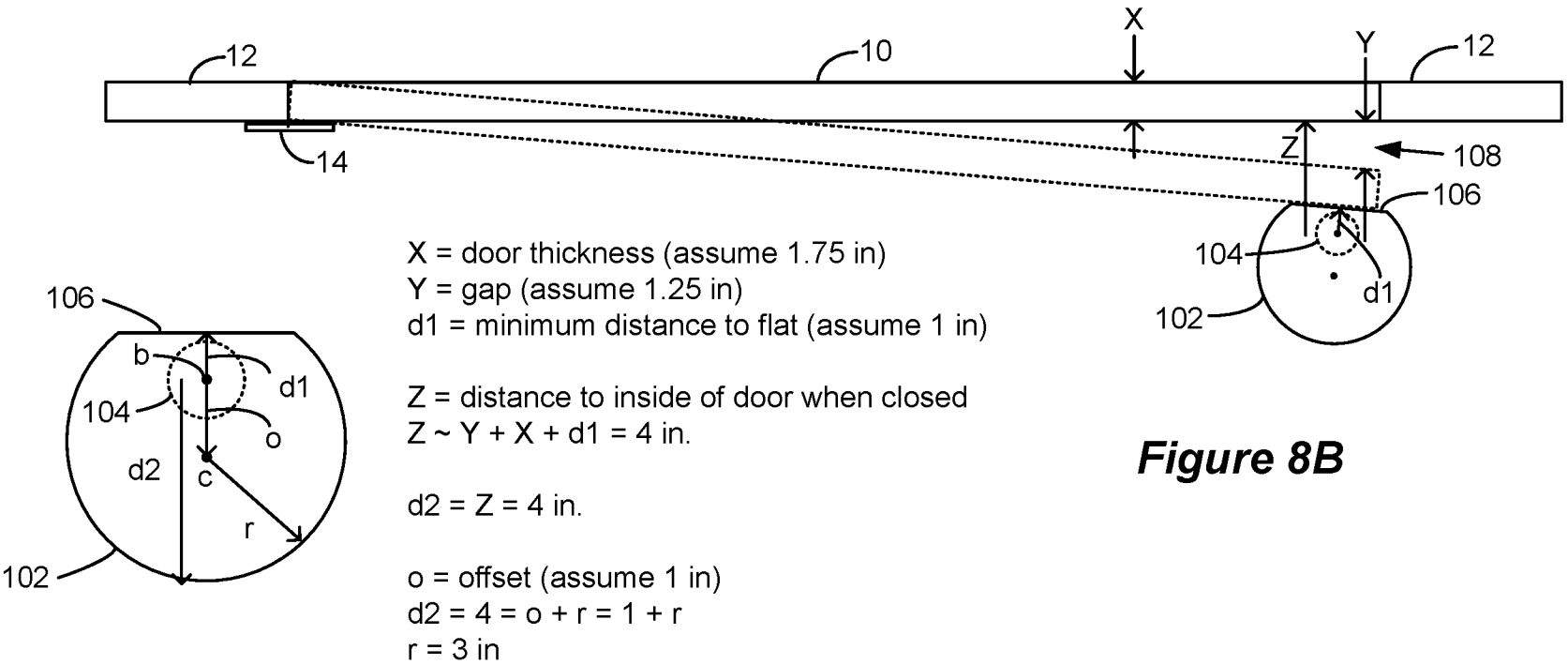
Figure 8C:
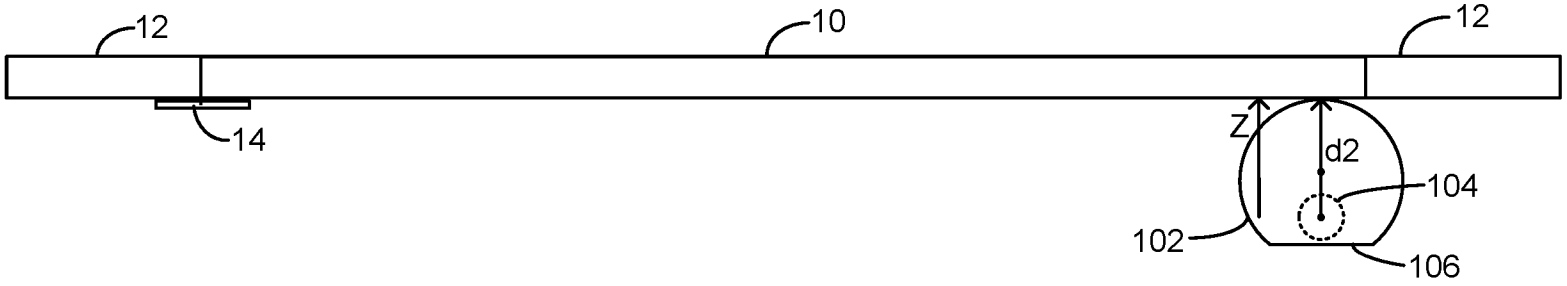

This enables the stop 100—more particularly its upper portion 102—to be made smaller, as shown in FIGS. 8B and 8C. These figures again assume a door thickness (X) of 1.75 inches, and a desired gap 108 (Y) of 1.25 inches. A minimum distance (d1) of 1 inch is assumed from the center 'b'. As before, this warrants that center 'b' of the lower portion 104 be placed a distance Z from the inside of the door 10 when it is closed, which is again approximately Y+X+d1 or approximately 4 inches (again, ignoring the small angle).

This will provide the desired gap 108 when the upper portion 102 is in the first mode (FIG. 8B). The offset 'o' between centers 'c' and 'b' will then dictate the radius 'r' of the upper portion 102 as necessary to barricade the door 10 when it is closed in the second mode (FIG. 8C). Assume for example that this offset 'o' is 1 inch. In the second mode, the maximum distance d2 from the center 'b' must equal Z (approximately 4 inches) to brace the door closed. Notice that d2=o+r, and so if d2 is 4, and o is 1, the radius 'r' of the upper portion 102 relative to its center point 'c' must be 3 inches. In short, by offsetting the lower portion 104 relative to the center of the upper portion 102, the stop 100 can provide the same dual-mode barricading functionality, but with an upper portion 102 that is smaller in size, i.e., with a radius 'r' of 3 inches (FIGS. 8B & 8C) compared to 4 inches (FIGS. 7D & 7E).

Figure 9A:
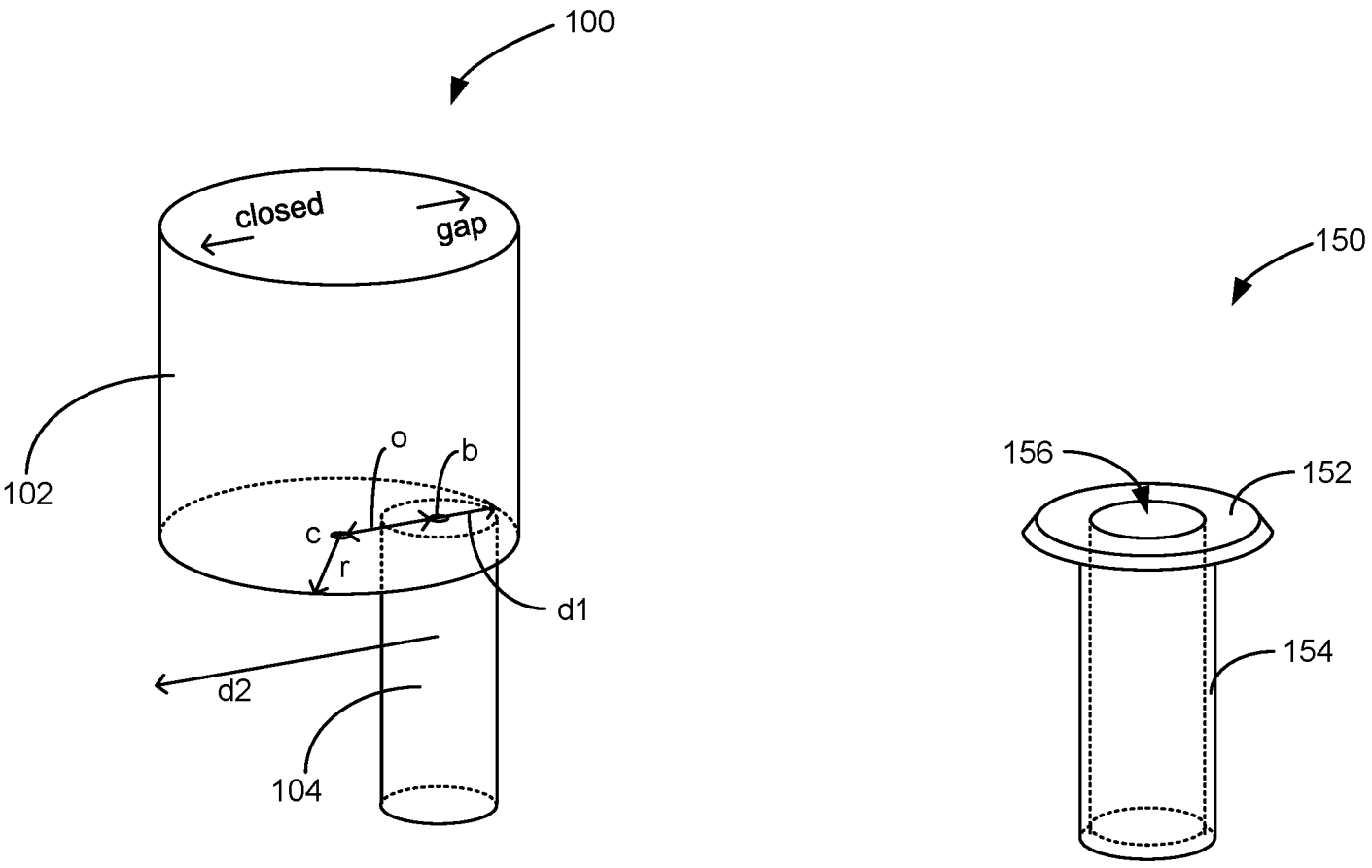
FIGS. 9A-9C show another example of the stop and receptacle configurable in the two modes of operation by rotation.
Figure 9B:
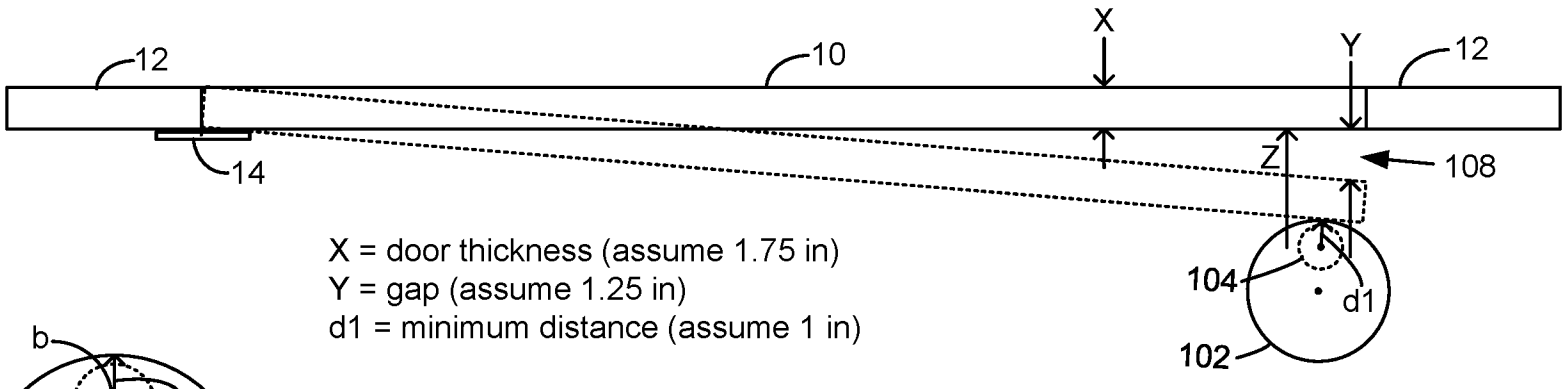
Figure 9B:
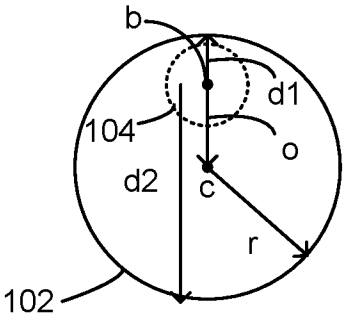
Figure 9C:
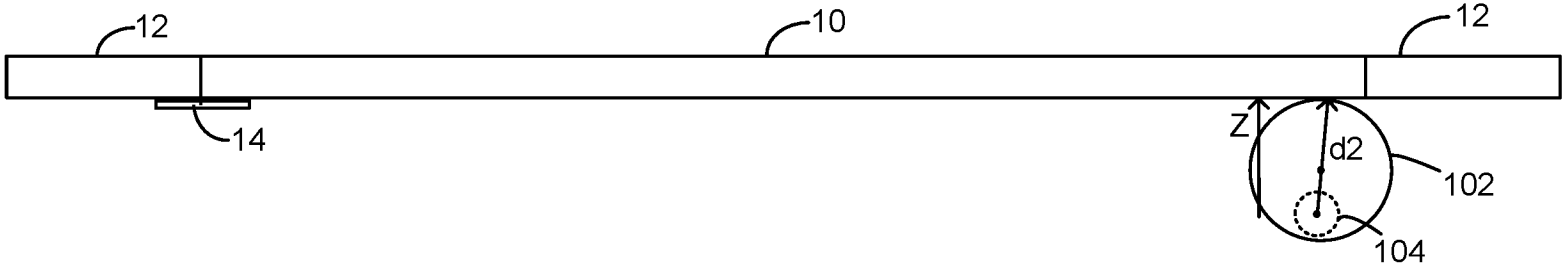

FIGS. 9A-9C show another example of the stop 100 having an offset lower portion 104 from the upper portion 102, but in this example, the upper portion 102 does not include a flat surface 106. Instead, and as shown in FIG. 9A, the center 'b' of the lower portion 104 is positioned at minimum and maximum distances d1 and d2 from the cylindrical edge of the upper portion 102. If it is assumed that the d1 equals 1 inch (as necessary to create the desire gap 108 in the first mode; FIG. 9B) and d2 equals 4 inches (as necessary to brace the door shut in the second mode; FIG. 9C), then the radius of the upper portion 102 would equal 2.5 inches (2r=d1+d2), meaning the center 'b' of lower portion 104 would be offset 'o' from the center 'c' of the upper portion 102 by 1.5 inches (r=o+d1). Again, the stop 100 can provide the same dual-mode barricading functionality, but with an upper portion 102 that is smaller in size, i.e., with a radius 'r' of 2.5 inches.

Because the upper portion 102 has no flat surface 106 in the example of FIGS. 9A-9C, notice that rotation of the stop 100 to different angles within the receptacle 150 allows the size of the gap 108 (Y) to be varied, from its maximum value of 1.25 down to zero. Because a flat surface 106 can visually assist the user in understanding how to rotate the stop 100 into the first and second modes, but is lacking in this example, it may be useful to provide arrows or other indicators on the top of the upper portion 102. For example, in FIG. 9A, the top of the upper portion 102 has been marked with a first arrow (parallel to d1) to indicate the first mode ('gap'; FIG. 9B), and a second arrow (parallel to d2) to indicate the second mode ('closed'; FIG. 9C). The user can then configure the stop 100 between the two modes by rotating the stop 100 with the desired arrow pointing to the door 10.

Figure 10:
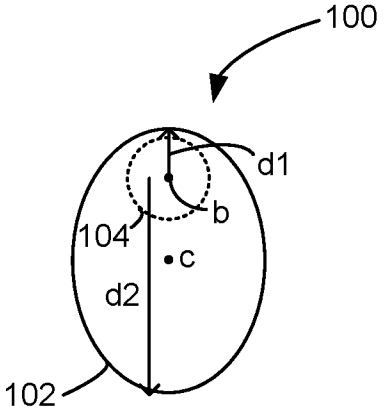
FIG. 10 shows another example of the stop and receptacle configurable in the two modes of operation by rotation.

FIG. 10 shows another example of the stop 100 that is essentially the same as the example just described in FIGS. 9A-9C—i.e., having an offset lower portion 104 and minimum and maximum distances d1 and d2. However, in this example, the upper portion 102 is not cylindrical, but is instead of an oblong shape. This provides the same functionality as the example of FIGS. 9A-9C, although the oblong shape cuts down of the amount of material needed (and hence the weight) of the upper portion 102.

Figure 11A:
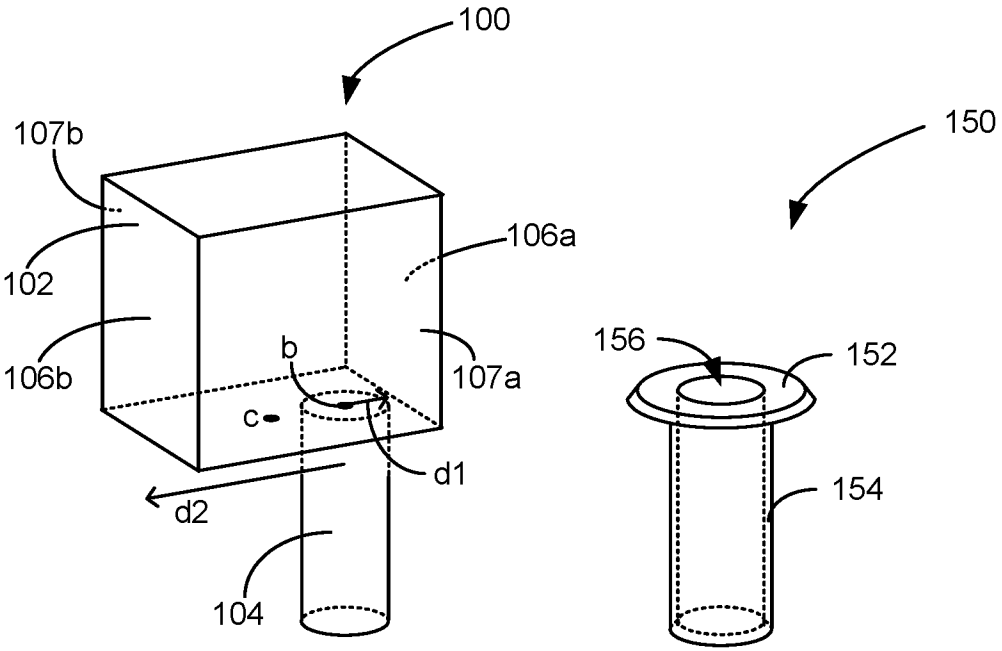
FIGS. 11A-11C show a another example of the stop and receptacle configurable in the two modes of operation by rotation.
Figure 11B:
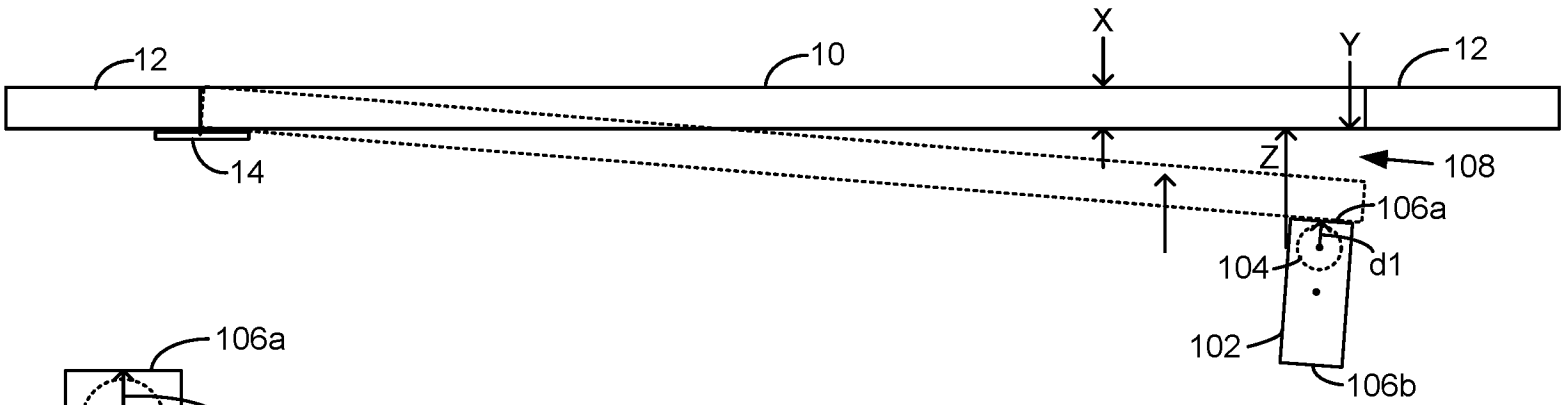
Figure 11C:
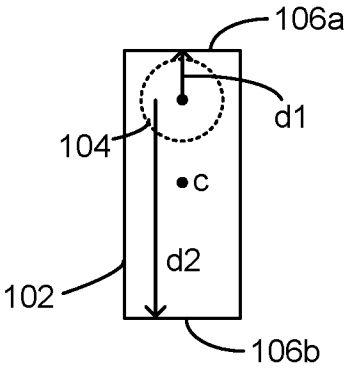
Figure 11C:
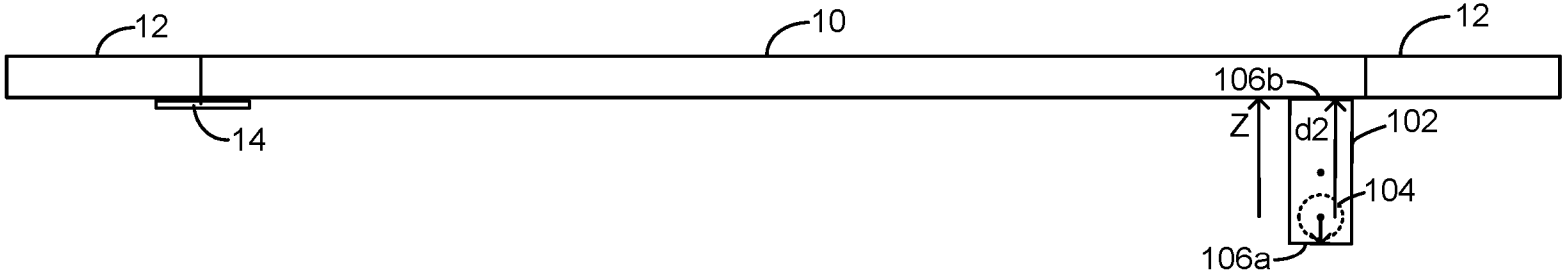

FIGS. 11A-11C provides another functionally similar example, although in this example the upper portion 102 includes two flat surfaces 106*a* and 106*b*. More particularly, the upper portion 102 in this example is rectangular, having sides 107*a* and 107*b* that are perpendicular to the flat surfaces 106*a* and 106. However, these sides 107*a* and 107*b* can be shaped differently and need not be perpendicular.

Again in this example, and as shown in FIG. 11A, the lower portion 104 is offset ('b') from the center ('c') of the upper portion 102, thus defining a minimum distance d1 to flat surface 106*a*, and a maximum distance d2 to flat surface 106*b*. These distances d1 and d2 may be 1 and 4 inches respectively as in earlier examples. During use of the stop 100, the upper portion 102 may be rotated into the first and second modes as shown in FIGS. 11B and 11C respectively. Note that in the first mode allowing for a gap 108 (FIG. 11A), flat surface 106*a* is made to face the door 10, while in the second mode that braces the door while shut, flat surface 106*b* is made to face the door. The stop 100 in this example may be easier to use, because visually-identifiable flat surfaces 106*a* and 106*b* assist the user in placing the stop in the first and second modes. Furthermore, this example can be beneficial in reducing the amount of material needed for (and weight of) the upper portion 102.

Figure 12A:
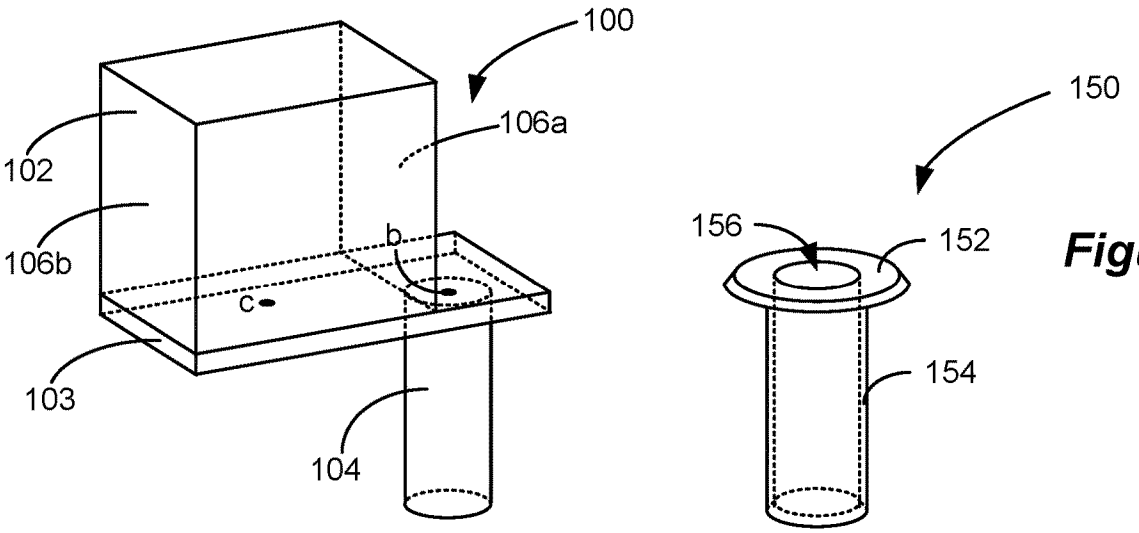
FIGS. 12A-12E show another example of the stop and receptacle configurable in the two modes of operation by rotation.

FIGS. 12A-12E show yet another example of the stop 100. In this example, shown first in FIG. 12A, the lower portion 104 is again offset ('b') from the center ('c') of the upper portion 102, which is again in this example rectangular with flat surfaces 106*a* and 106*b*. However, as well as being offset, the center 'b' of the lower portion 104 does not lie under the upper portion 102 at all. As such, center point 'b' of the lower portion 104 is not between surfaces 106*a* and 106*b* of the upper portion 102. Because of this, a horizontal connecting portion 103 is used, as shown in FIG. 12A. Connecting portion 103 may be made of the same materials as the upper and lower portions 102 and 104. The connection portion 103 may be consider as a part of, and may be formed with, either the upper or lower portions 102 or 104. The center point 'b' of the lower portion 104 is located at a minimum distance d1 from the closest flat surface 106*a*, and at a maximum distance d2 from the farther flat surface 106*b*.

Figure 12C:
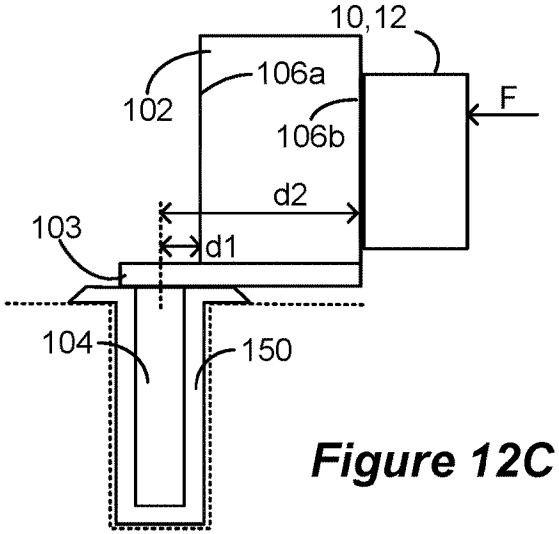
Figure 12B:
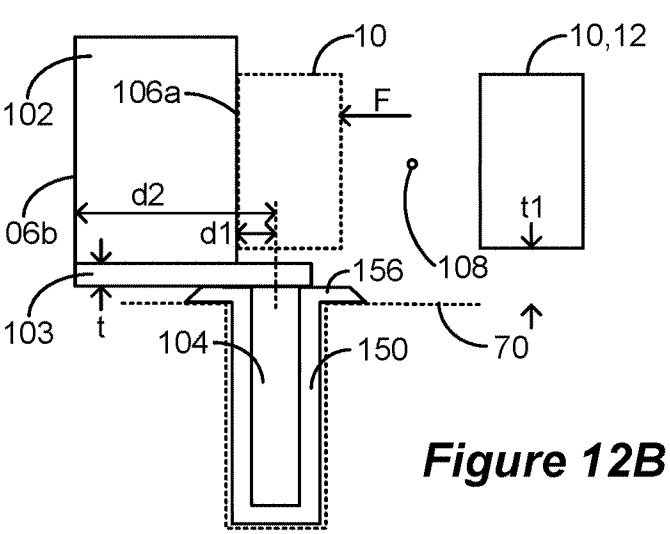
Figure 12D:
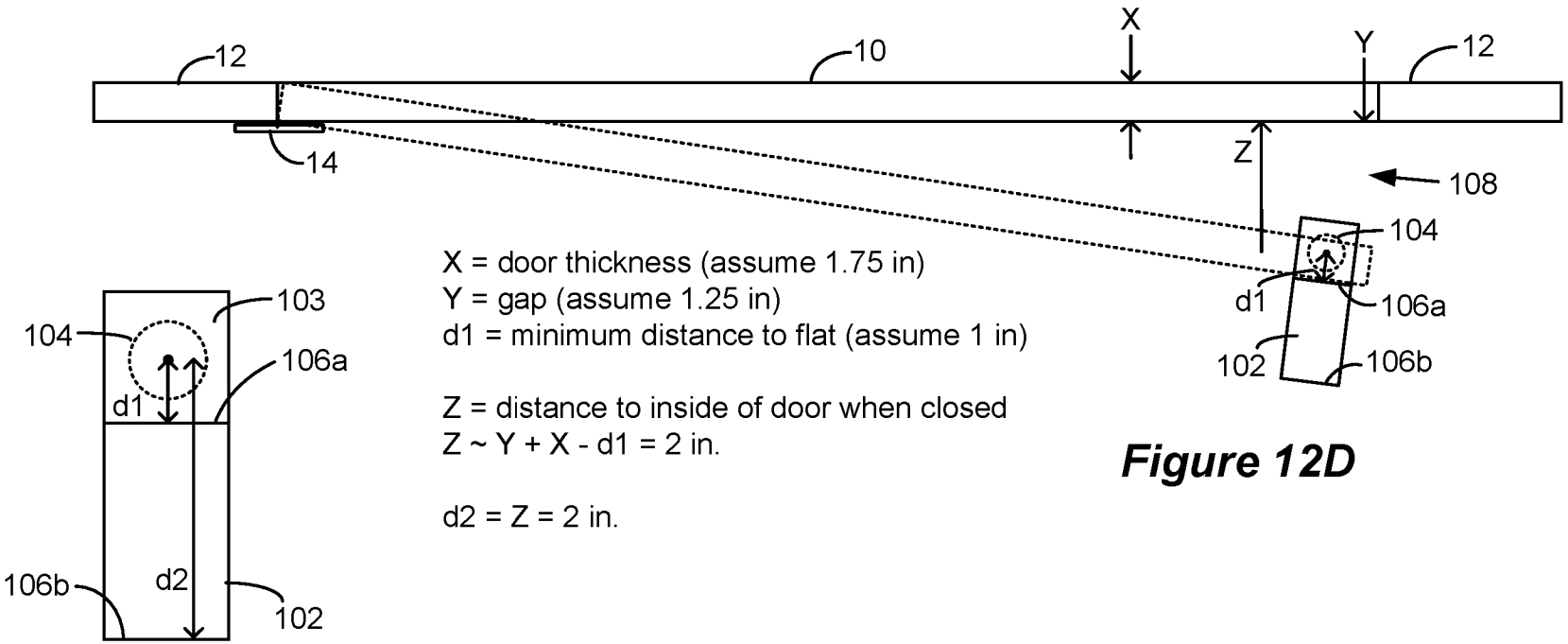
Figure 12E:
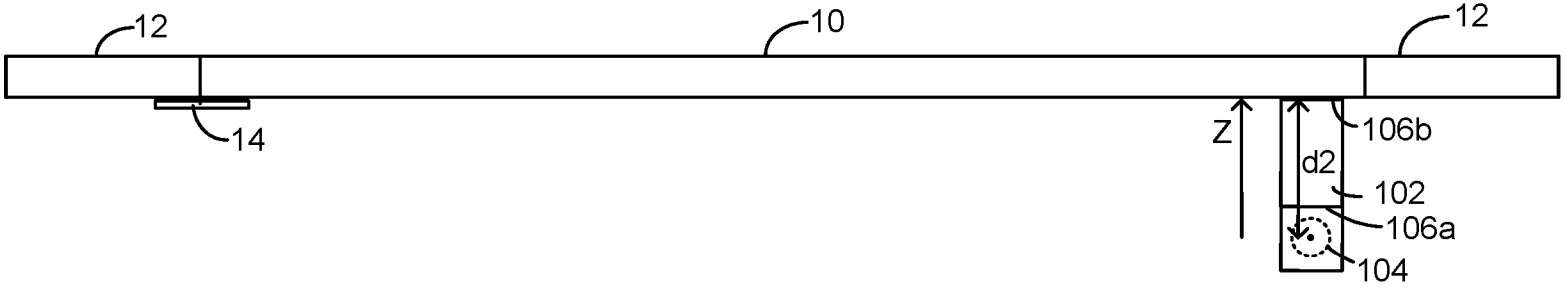

The stop 100 is configurable into the first mode, to create a gap 108, by rotating the upper portion 102 so that the flat surface 106*a* is facing the door, as shown in FIGS. 12B and 12D. Notice in FIG. 12B, when in the first mode, that the door 10 may need to swing at least in part over the connecting portion 103 before contacting flat surface 106*a*. In this regard, connecting portion 103 should be formed with a thickness t that is less than the clearance t1 between the bottom of the door 10 and the floor 70. (Further, because the connecting member 103 may come to rest on lip 156, if present, the summed thickness of the connecting portion 103 and the lip 156 should be less than clearance t1). FIGS. 12C and 12E show the stop 100 in the second mode which braces the door 100 when it is closed. In this second mode, the upper portion 102 is rotated so that flat surface 106*b* is facing the door 10. FIGS. 12D and 12E analyze dimensions that can be used to create the stop in this example, and generally show that the stop 100 may be made significantly smaller (and lighter) in this example than in other examples.

Figure 13A:
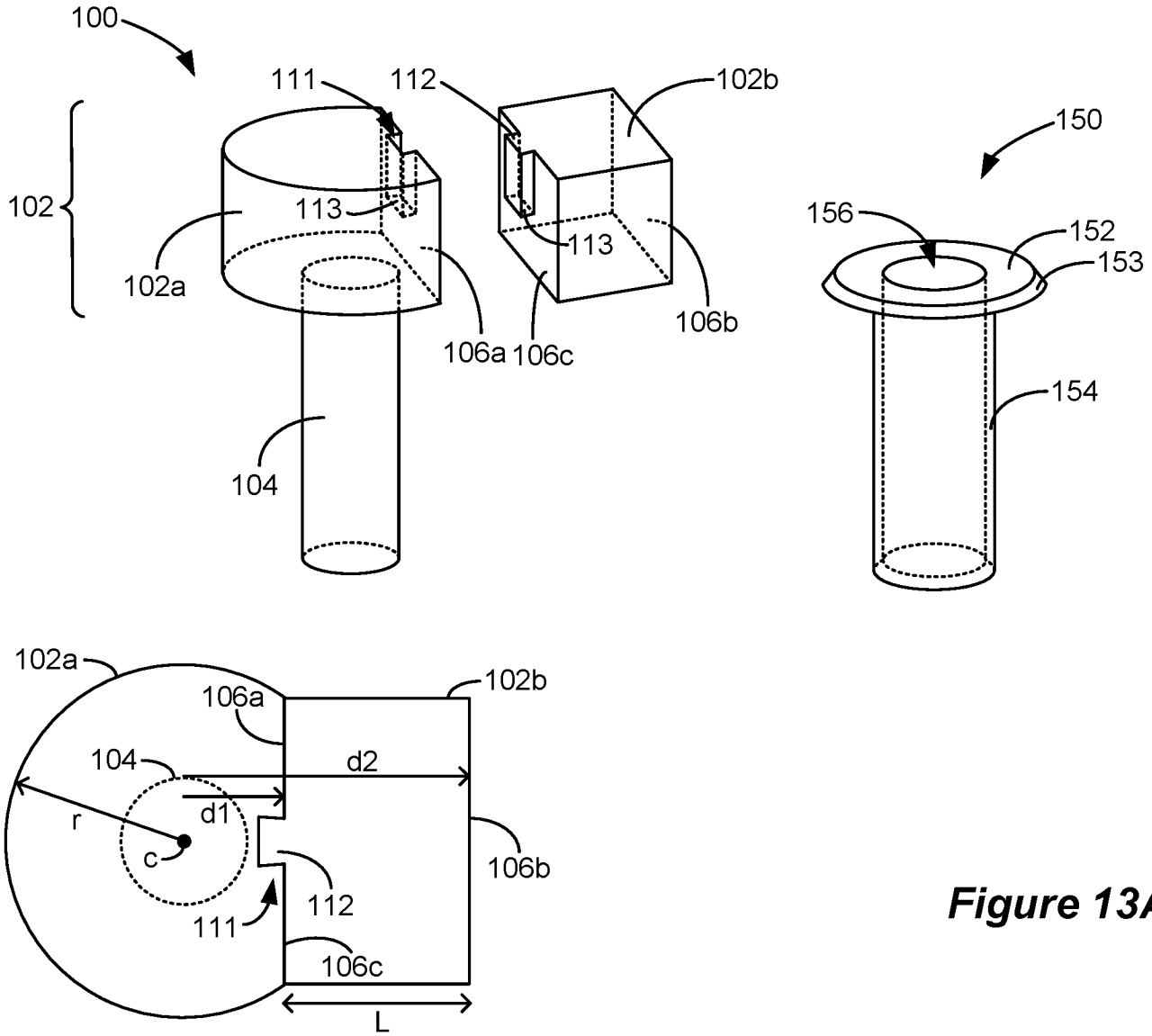
FIGS. 13A-13C show an example of the stop and receptacle configurable in the two modes of operation, in which configuration occurs by attaching an extension to the stop.
Figure 13C:
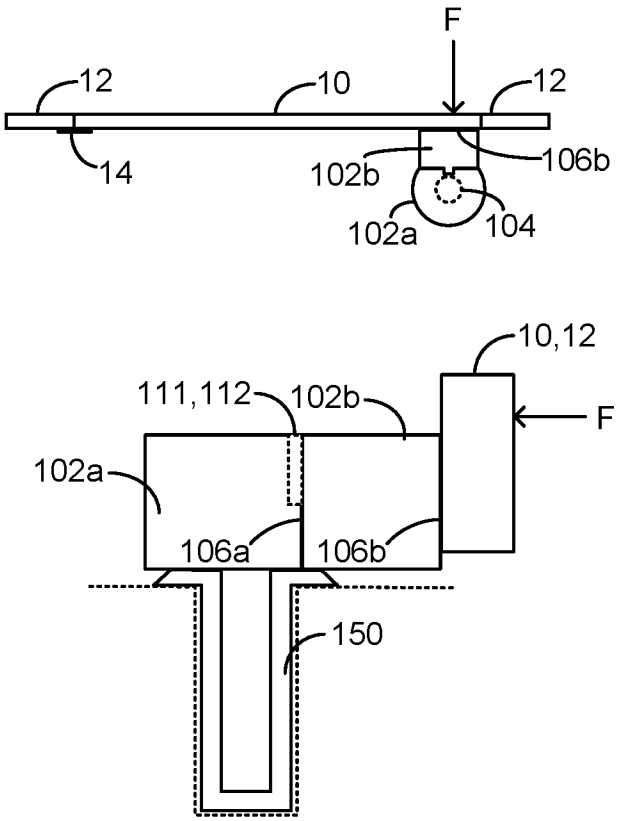
Figure 13B:
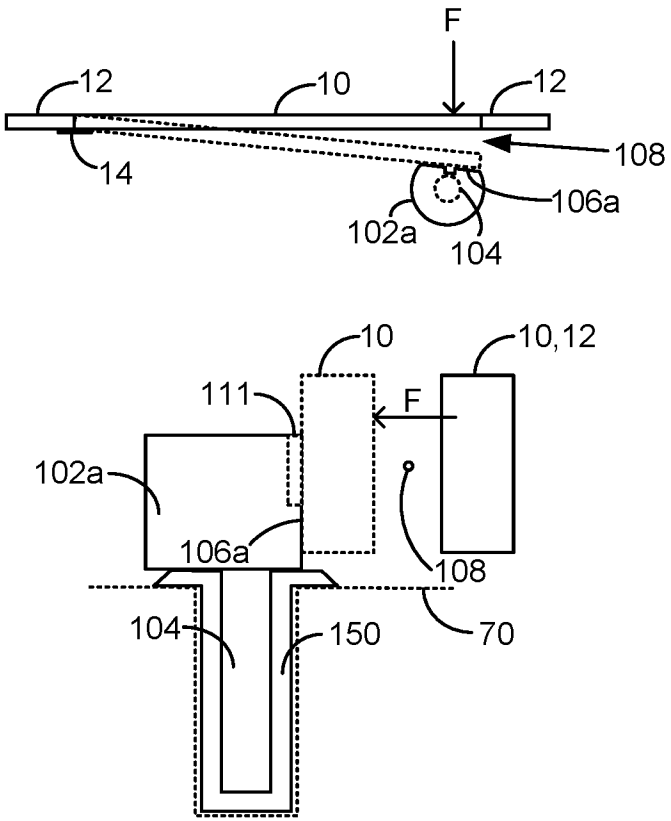

To this point, the stop 100 has been described as being configurable into the first and second modes by rotating the stop 100 within the receptacle 150. However, the stop 100 may be configurable by the user into the first and second modes in other ways that do not rely exclusively on rotation. FIGS. 13A-13C show another example of the stop 100, which as before has a lower portion 104 and an upper portion 102. However, the upper portion 102 is split into a first portion 102*a* and an extension 102*b* that is coupleable to the first portion 102*a*. In the first mode allowing for the gap 108, the extension 102*b* is not connected to the first portion 102*a*, while in the second mode that braces the door when closed, the extension 102*b* is connected to the first portion 102*a*, as explained below.

Before explaining the use of stop 100 in this example, the manner in which first portion 102*a* and extension 102*b* can be connected is first explained. In the example shown in FIG. 13A, the first portion 102*a* includes a slot 111 positioned on a flat surface 106*a*, while the extension 102*b* includes a corresponding tab 112 on flat surface 106*c*. As shown in the top down view in FIG. 13A, the slot 111 and tab 112 can have angled edges which allows the portions 102*a* and 102*b* to be connected when the tab 112 is slid into the slot 111. In another example, the slot 111 and tab 112 can be "T" shaped, as opposed to angled edges, as shown at the bottom of FIG. 13A. Notice that the tab 112 includes a horizontal bottom edge 113 that will bottom out on a corresponding bottom edge 113 within the slot 113, which positions the extension 102*b* at the correct height relative to the first portion 102*a*. Notice that when portions 102*a* and 102*b* are connected, flat surfaces 106*a* and 106*c* are preferably in contact. Portions 102*a* and 102*b* may also be connected in different manners that are not illustrated. For example, slot 111 can comprise a threaded hole while tab 112 may comprise a threaded rod, which would portions 102*a* and 102*b* to be screwed together.

As noted above, the stop 100 is configurable into the first mode when the lower portion 104 and first portion 102*a* are used alone without extension 102*b*, as shown in FIG. 13B. In this example, the stop 100 is rotated such that flat surface 106*a* of the first portion 102*a* is facing the door, such that the door will contact this surface after it is opened by a gap 108. The slot 111 on flat surface 106*a* will also face the door 10, but this will not interfere with flat surface 106*a*'s ability to barricade the door. The stop 100 is configurable into the second mode, allowing a closed door to be braced, by connecting extension 102*b* to first portion 102*a* as described above, and as shown in FIG. 13C. Notice that extension 102*b* has a flat surface 106*b* opposite the flat surface 106*c* that contacts flat surface 106*a*. In the second mode, this flat surface 106*b* is made to face the door and to barricade it while it is closed.

In practice then, a user can use the stop 100 of FIGS. 13A-13C as follows. A user at home can close the door 10 and portions 102*a* and 102*b*, and then place the stop 100 in the receptacle 150 with flat surface 106*b* facing the door. This barricades the closed door in the second mode (FIG. 13C). If a visitor knocks or rings the door bell, the user can reach down and remove the extension 102*b* from the first portion 102*a* (e.g., by sliding it upwards). This configures the stop 100 in the first mode (FIG. 13B), which allow the door 10 to be opened by a gap 108, while still keeping the door barricaded via flat surface 106*a* of the first portion 102*a*. After the visitor has left, the user can again close the door 10 and reach down and re-connect the extension 102*b* to the first portion 102*a* to re-secure the door in the second mode. If the user needs to open the door fully, all components of the stop 100 are removed from the receptacle 150. It should be clear from other examples described to this point that the stop 100 can be dimensioned with a minimum distance d1 from point 'c' (e.g., 1 inch) to flat surface 106*a* to allow operation in the first mode, and with a maximum distance d2 (e.g., 4 inches) to flat surface 106*b* (when extension 102*b* is connected) to allow operation in the second mode, meaning that the extension 102*b* can be formed with a length 1' between flat surfaces 106*b* and 106*c* of 3 inches.

Figure 14A:
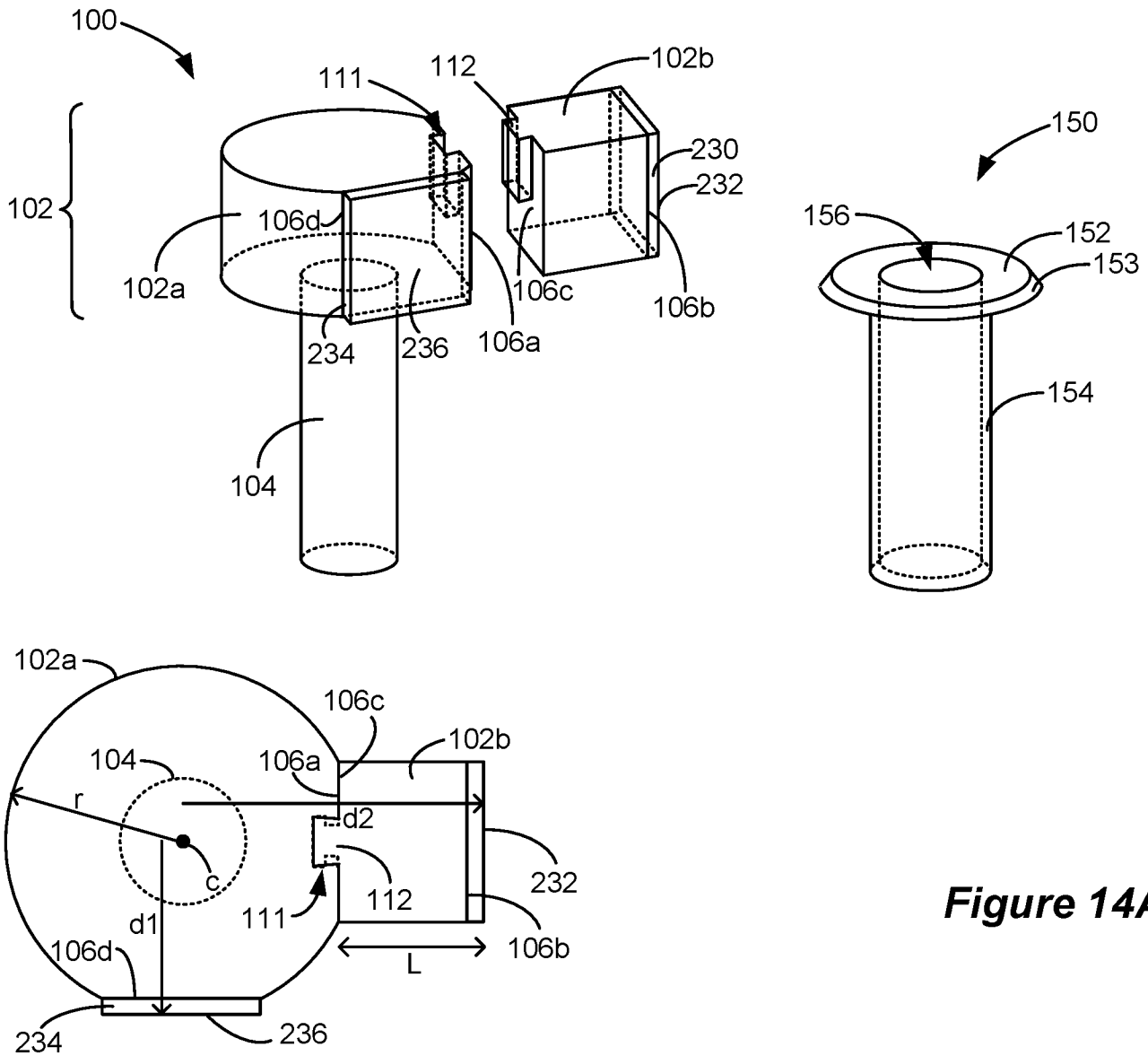
FIGS. 14A-14C show another example of the stop and receptacle configurable in the two modes of operation by use of an extension.
Figure 14B:
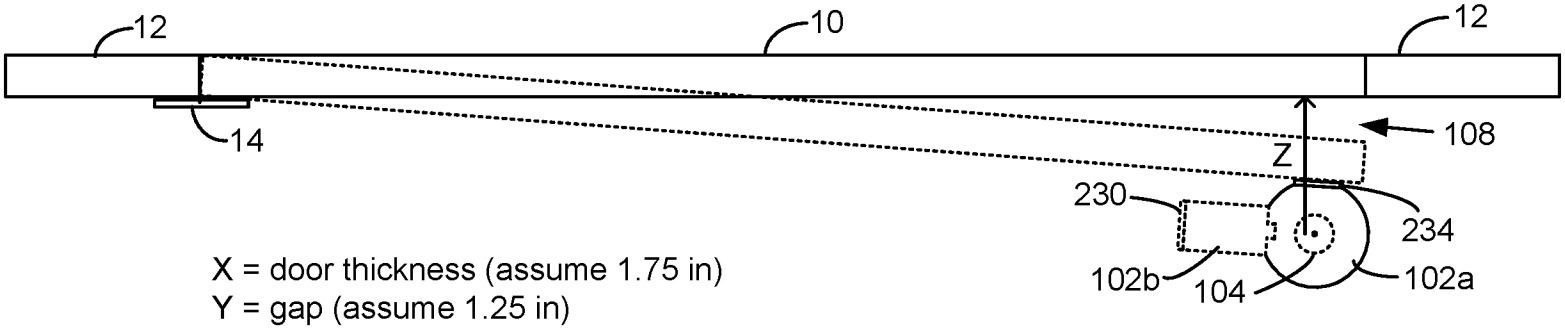
Figure 14C:
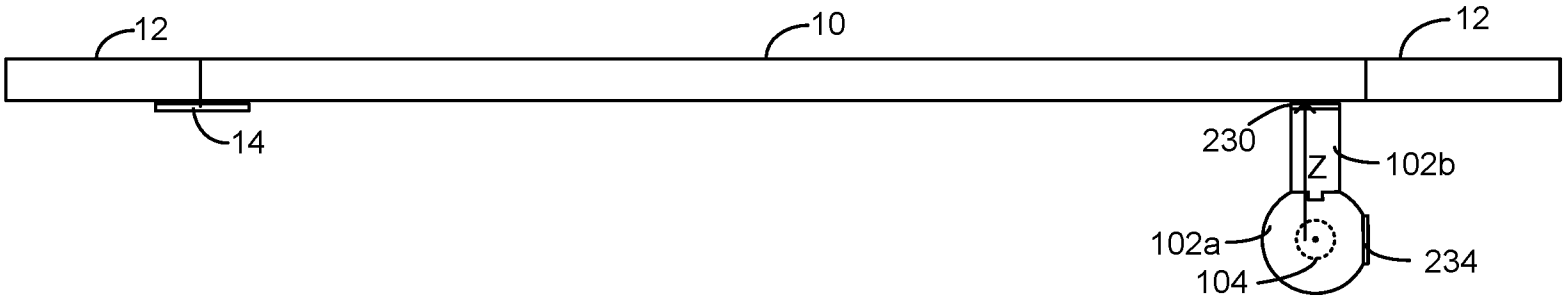

FIGS. 14A-14C show another version of stop 100 that is similar to the stop of FIGS. 13A-13C in that it uses an extension 102*b* to assist the user into configuring the stop into the two modes. Stop 100 again includes a lower portion 104, and an upper portion 102 that is split into a first portion 102*a* and an extension 102*b* that is coupleable to the first portion 102*a*. In the first mode allowing for the gap 108, the extension 102*b* is not connected to the first portion 102*a*, while in the second mode that braces the door when closed, the extension 102*b* is connected to the first portion 102*a*, as explained below.

The first portion 102*a* in this example has two vertical flat surfaces 106*a* and 106*d* that are cut into the otherwise cylindrical periphery of the first portion 102*a*. Preferably, these surfaces 106*a* and 106*d* are at right angles to each other around the periphery as shown in FIG. 14A. That being said, the surfaces 106*a* and 106*d* can appear at different angles, with angles between 90 and 270 (e.g., 180 degrees) being logical choices. Surface 106*a* as before (FIGS. 13A-13C) includes a slot 111, while the extension 102*b* includes a corresponding tab 112 on flat surface 106*c*. As described earlier, the slot 111 and tab 112 can have angled edges, or can be "T" shaped, to allow the portions 102*a* and 102*b* to be connected when the tab 112 is slid into the slot 111. Horizontal bottom edges 113 on the tab 112 and in the slot 111 positions the extension 102*b* at the correct height relative to the first portion 102*a*. As before, when portions 102*a* and 102*b* are connected, flat surfaces 106*a* and 106*c* are preferably in contact. Portions 102*a* and 102*b* may also be connected in different manners that are not illustrated. Extension 102*b* has a vertical flat surface 106*b* opposite and parallel to surface 106*c*, and in this example, a pad 230 has been affixed to surface 106*b*. Pad 230 as before has a vertical flat surface 232 that contacts the door when the extension is used in the second mode. A pad 234 having a vertical flat surface 236 is affixed to surface 106*d*, which is used in the second mode. Pads 230 and 234, while useful to help absorb an external force and protect the inner surface of the door, are not strictly required.

Use of the stop 100 is shown in FIGS. 14B and 14C in the first and second modes. In the first mode, shown in FIG. 14B, the user has placed and rotated the stop 100 so that the flat surface 106*d* (and surface 236 of its pad 234) are generally facing the door 10, such that the door will contact this surface after it is opened by a gap 108. In this first mode, the extension 102*b* isn't used, and the extension 102*b* can either be removed from the first portion 102*a* or left in place (as shown in the dotted lines). If the extension 102*b* is left in place, it is parallel to the door 10, and faces inwards towards the door. This is preferred, because a user is less likely to trip over the extension 102*b* when the stop 100 is being used. Again, the extension 102*b* in this first mode can also be removed by disconnecting the tab 112 from the slot 111.

FIG. 14C shows the second mode in which the stop 100 barricades the door 10 when it is closed in the frame 12. In this mode, the user rotates the stop 100 clockwise by approximately 90 degrees in the receptacle 150, and connects the extension 102*b* to the first portion 102*a* (if it is not already connected). Rotating the stop 100 causes the surface 106*b* of the extension 102*b* (and surface 232 of its pad 230) to generally face the door 10, which barricades the door in the closed position. The stop 100 can later be configured by the user back into the first mode (FIG. 14B) by rotating the stop 90 degrees counter-clockwise, at which point the user can then remove the extension 102*b* if desired or leave it in place. As in earlier examples, the stop 100 can be removed from the receptacle 150 when the user desires to open the door fully.

Referring again to FIG. 14A, the stop 100 may be dimensioned such that distance d1 to surface 106*d* (or surface 236 of pad 234) is approximately equal to the radius of the first portion 102*a* (e.g., 1.5 inches). As shown in FIG.

14B, this implies that distance Z would equal 4.5 inches to allow for a 1.25 inch gap in the first mode. To barricade the door when closed in the second mode (FIG. 14C), the extension 102*b* would have a length L of 3 inches. As with other examples, these dimensions could vary and are non-limiting.

Figure 15A:
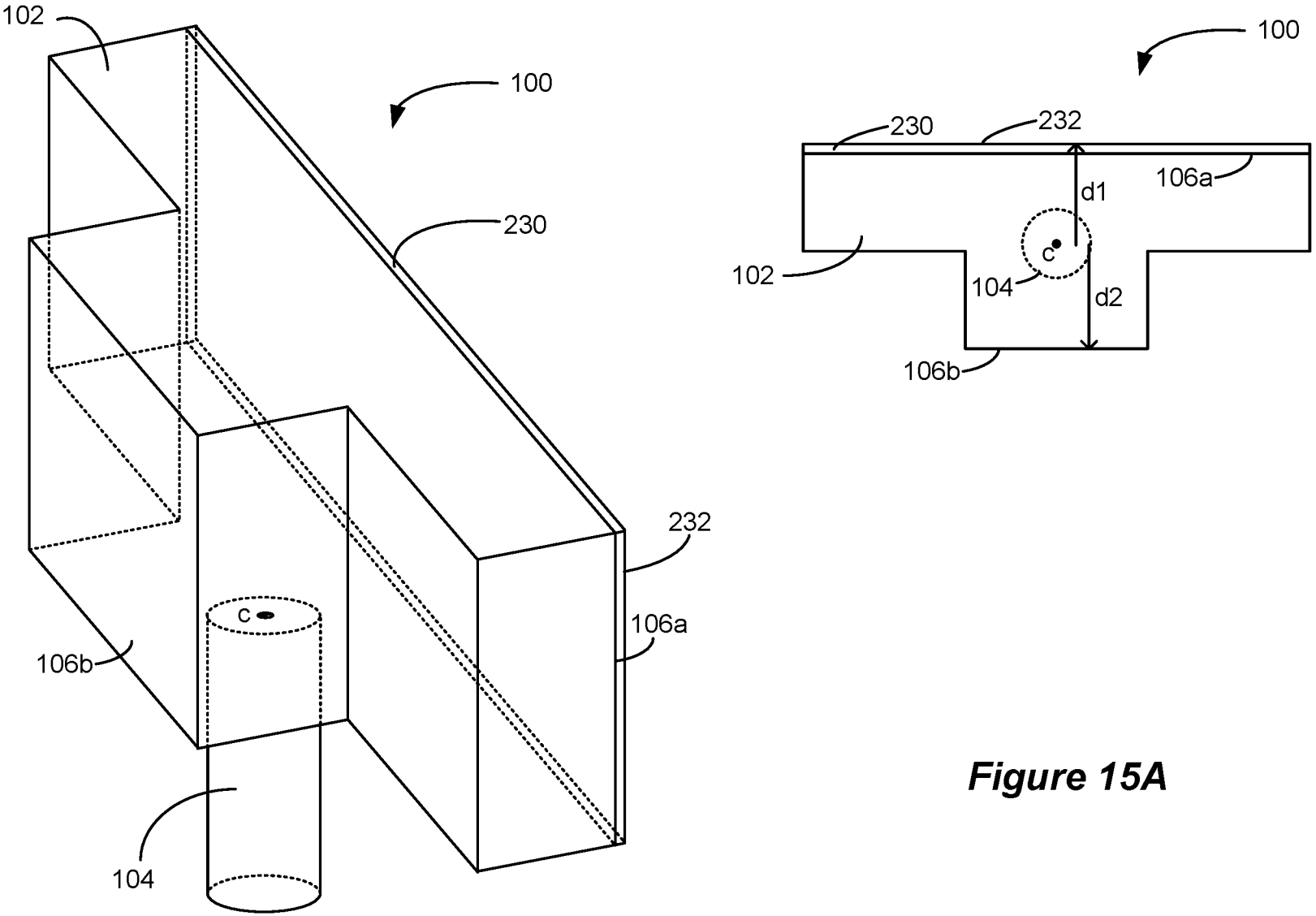
FIGS. 15A-15C show another example of the stop that can be used to barricade two (double) doors.
Figure 15B:
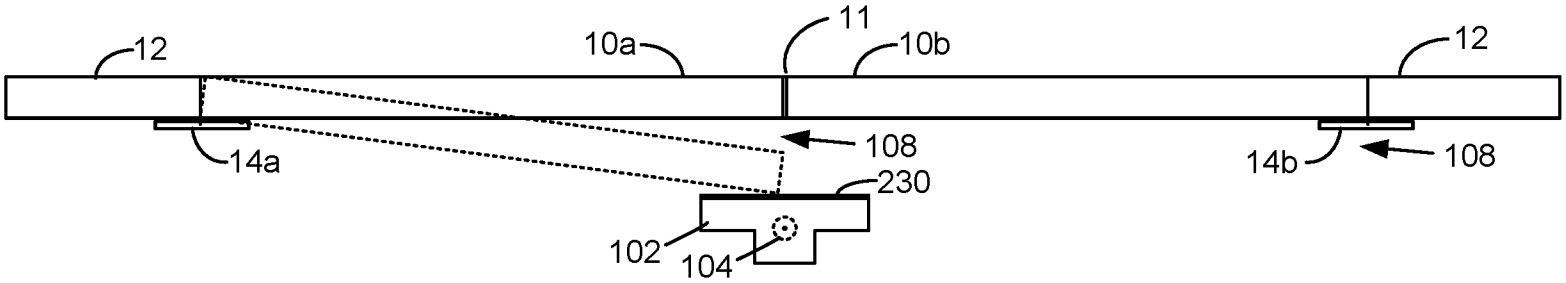
Figure 15C:
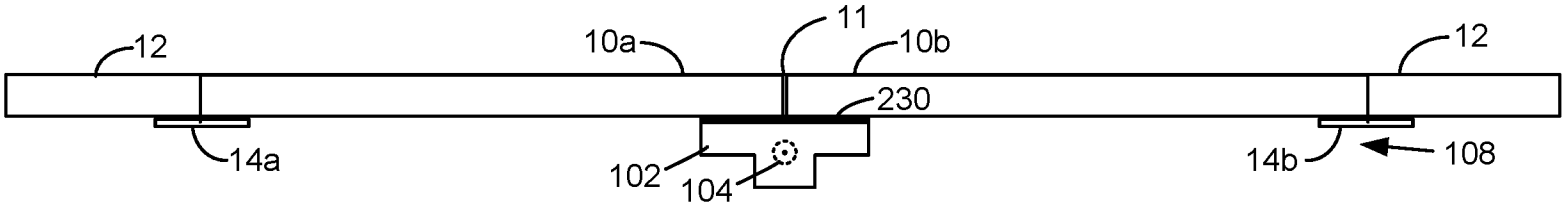

Some doors that a user might wish to barricade may be double doors, with left and right doors 10*a* and 10*b* that are both openable and potentially vulnerable to forced entry. Variations can be made to the stop 100 to allow it to barricade such double doors, and an example is shown in FIGS. 15A-15C. As shown in FIG. 15A, a double-door stop 100 includes as before an upper portion 102 and a lower portion 104. The upper portion 102 includes a vertical flat surface 106*a* which can contact and barricade both of door portions 10*a* and 10*b*. In this example, the surface 106*a* is larger in surface area, to allow it to contact either of doors 10*a* or 10*b* when installed. Optionally, a pad 230 as described earlier can be affixed to the surface 106*a*, with the pad 230 having a vertical flat surface 232 that can contact the doors 10*a* and 10*b*.

FIGS. 15B and 15C show examples of this stop 100 in operation. As before (e.g., FIGS. 6B & 6C), the system 90 can be installed in the floor 70 at different locations relative to the doors 10*a* and 10*b*. In FIG. 15B, the receptacle 150 (not shown, but which again receives the lower portion 104 of stop 100) has been installed generally in line with a seam 11 between the two doors 10*a* and 10*b*. The receptacle 150 in this example is also installed further away from the doors 10*a* and 10*b*, thus allowing a gap 108 to form when either of the doors 10*a* and 10*b* are opened while still keeping the doors barricaded and opening further beyond the gap. This is shown in FIG. 15B with respect to door 10*a*, although door 10*b* when opened would have a similar gap 108. Notice that the door 10*a* can be opened to the point where in the inside surface of the door contacts the surface 106*a*, or surface 232 is pad 230 is used. In FIG. 15C, the receptacle 150 has been positioned closer to the door, such that the doors 10*a* and 10*b* are barricaded when they are closed. Again, as with FIGS. 6B and 6C, the stop 100 is configurable into the two modes depending on how it is installed.

The stop 100 of FIGS. 15A-15C can be modified in ways described earlier. For example, and referring to FIG. 15A, notice that the upper portion 102 has another vertical flat surface 106*b* that is parallel to surface 106*a*. This surface 106*b* (or a pad attached to it, not shown) can also be made to face the doors 10*a* and 10*b* to provide a barricading function. Further, the lower portion 104 may be offset, such that distance d1 (from center c to surface 106*a* or 232) is larger than distance d2 (from center c to surface 106*b* or a pad attached to that surface). This may allow for the user to configure the stop 100 in the receptacle 150 into the two modes described earlier: in a first mode, the user may position surface 106*b* towards the doors 10*a* and 10*b* to allow it to be opened by a gap 108; and in a second mode, the user may position surface 106*a*/232 towards the doors to barricade the doors 10*a* and 10*b* while they are closed. This is similar in nature to examples of the stop 100 described earlier with respect to FIGS. 7A-12E. Stop 100 of FIGS. 15A-15C could be used with single doors 10 as well.

One skilled in the art will understand that the various aspects of the stop 100 shown to this point can be combined in different manners to achieve different advantages. It is neither practical nor necessary to show all such possible combinations.

FIGS. 16-19 show other practical aspects of the system 90. In these Figures, the stop 100 is shown as described earlier with respect to FIGS. 7A-7E. However, the aspects shown in FIGS. 16-19 could apply to any of the examples of the stop 100 shown earlier.

Figure 16:
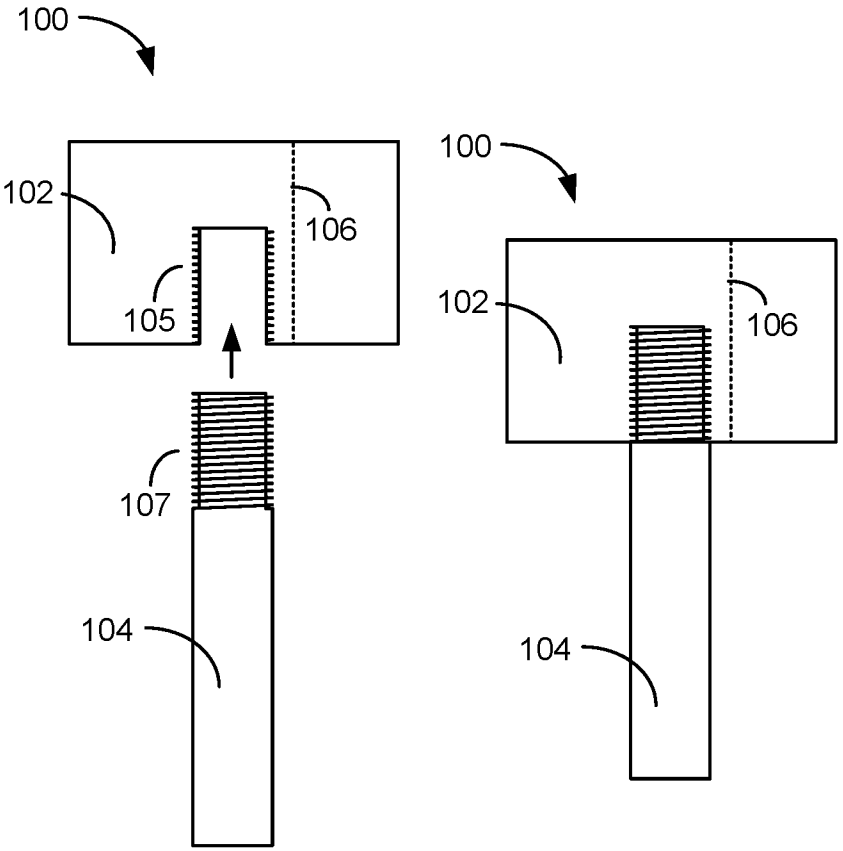
FIG. 16 shows that the stop may be formed of more than one piece.

FIG. 16 shows that the stop 100 can be made from components that are affixed together. For example, the upper portion 102 and lower portion 104 can comprise separate affixable pieces. As shown, lower portion 104 can include a threaded end 107, which can be screwed into a threaded opening 105 formed on the underside of the upper portion 102. This may be easier and cheaper to manufacture compared to forming the stop 100 (upper and lower portions 102 and 104) as a single piece.

Figure 17:
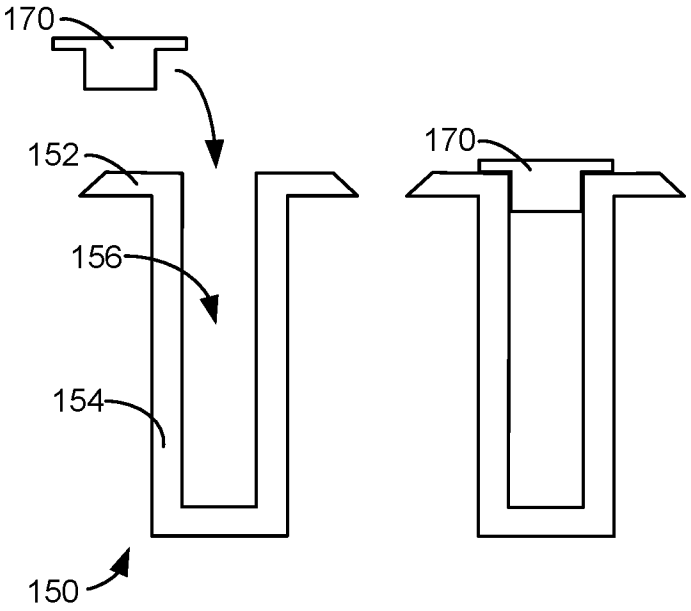
FIG. 17 shows that the opening in the receptacle can be covered by a cap.

FIG. 17 show that the system 90 can include a cap 170 which a user can use to cover the opening 156 in the receptacle 150 when it is not being used with the stop 100. This is useful, as it prevents debris from falling down into the opening 156.

FIG. 18 shows a bracket or other hanging device 180 that can be used to hold the stop 100 when it is not in use—i.e., when it is not placed in the receptacle 150. Such a hanging device 180 could be made in many different ways, but as shown includes support 185 with an opening 184. To store the stop 100, the lower portion 104 can be placed though the opening 184, thus allowing the underside of the upper portion 102 to rest on the support 185. The hanging device 180 can also include screw holes 182 to allow the device 180 to be affixed to a structure. FIG. 18 shows that the hanging device 180 can be affixed to the door 10 itself, thus allowing the stop 100 to be conveniently stored in a location proximate to the receptacle 150 where it will be used. FIG. 18 also shows a strike plate 190 which can be affixed (e.g., using screw holes 192) to the door 10 to protect it in locations where the stop 100 (i.e., its upper portion 102) will contact the door.

Figure 19:
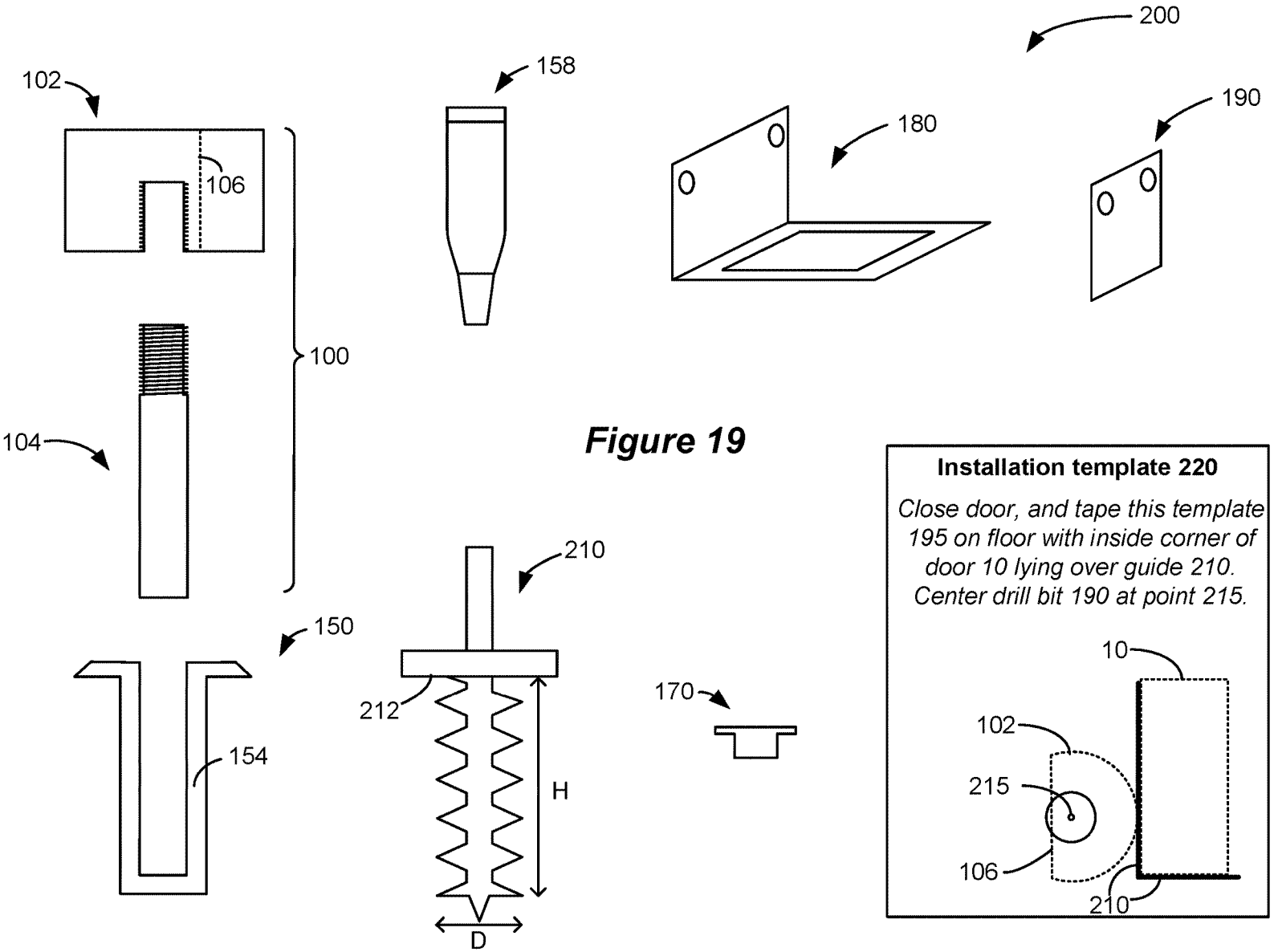
FIG. 19 shows various components that can be included in a kit to sell the system.

FIG. 19 shows components that can be included in a kit 200 that is used to sell the system 90 to consumers. The kit 200 can include the upper and lower portions 102 and 104 of the stop 100, which are shown as separate components in this example, and the receptacle 150. The kit can also include the cap 170, hanging device 180, and strike plate 190 mentioned earlier. The kit 200 can also include items that assist the user with installation of the system 90. For example, the kit 200 can come with a drill bit 210 that is used to form the hole 160 in the floor 70 that will accommodate the receptacle 150. The drill bit 210 may be sized appropriately in the diameter (D) and height (H) to match the outer dimensions of the side wall 154 of the receptacle 150. In this regard, the drill bit 210 may include a shoulder 212 to set the height appropriately. The kit 200 may also include a tube of an adhesive or cementing material 158, which as noted earlier can be used to affix the receptacle 150 in the hole 160 in the floor 70.

Lastly 200 the kit may include an installation template 220 which in particular can guide the user as to where he should drill the hole 160 in the floor. In the example shown, the template 220 comprises a sheet a paper which the user can tape to the floor 70, such that an inside corner of the door 10 overlies a guide 210 when closed is closed. The template 220 can then instruct the user to center the drill bit 210 at a point 215. The location of point 215 relative to the inside corner of the door 10 will depend on the dimensions of the components 90 in the system 90, which as noted earlier can vary. In any event, the location of point 215 is preferably located on the template 220 in light of the system's dimensions to ensure that the stop 100 will be configurable in the two modes described earlier. For example, point 215 should not be positioned too far away from the door 10, or the door 10 may not be barricaded when closed in the frame 12 in the second mode, or may have too large of a gap 108 in the first mode. The point 215 should also not be positioned too close to the door, or the stop 100 may not fit in the receptacle 150 when the upper portion 102 is contacting the door in the second mode.

Although particular embodiments of the present invention have been shown and described, it should be understood that the above discussion is not intended to limit the present invention to these embodiments. It will be obvious to those skilled in the art that various changes and modifications may be made without departing from the spirit and scope of the present invention. Thus, the present invention is intended to cover alternatives, modifications, and equivalents that may fall within the spirit and scope of the present invention as defined by the claims.

What is claimed is:

1. A system useable to barricade a door, comprising:

a stop comprising an upper portion configured to contact a door, and a lower portion connected to an underside of the upper portion, wherein the upper portion comprises a first portion connected to the lower portion and an extension connectable to the first portion at a first flat surface on a periphery of the first portion, wherein the first portion further comprises a second flat surface on the periphery of the first portion; and a receptacle comprising an opening to receive the lower portion of the stop when the stop is placed in the receptacle, wherein the receptacle is configured to be positioned in a hole in a floor proximate the door, wherein the stop when placed in the receptacle is configurable by a user in a first mode by not connecting the extension to the first portion, and in a second mode by connecting the extension to the first portion, wherein in the first mode the door can be opened by a gap before contacting the second flat surface, and wherein in the second mode the extension barricades the door while the door is closed, wherein in the second mode the extension is connectable to the first portion by vertically sliding the extension downward into place relative to the first portion, wherein in the first mode the extension is disconnected by vertically sliding the extension upwards from the first portion, and wherein the door can be opened by passing over the receptacle when the stop is not placed in the receptacle.

2. The system of claim 1, wherein the lower portion and opening are cylindrical.

3. The system of claim 1, wherein a central axis of the lower portion is colinear with a central axis of the first portion.

4. The system of claim 1, wherein in the second mode the extension faces the door.

5. The system of claim 1, wherein the first portion comprises a slot on the first flat surface and wherein the extension comprises a tab, wherein in the second mode the extension is connectable to the first portion by sliding the tab into the slot.

6. The system of claim 5, wherein the tab comprises a horizontal bottom edge and the slot comprises a horizontal bottom edge, wherein the horizontal bottom edge of the tab bottoms out on the horizontal edge of the slot when the extension is connected to the first portion.

* * * * *